US006144348A

United States Patent [19]

Kanazawa et al.

[11] Patent Number: 6,144,348

[45] **Date of Patent: *Nov. 7, 2000**

[54] PLASMA DISPLAY PANEL HAVING DEDICATED PRIMING ELECTRODES OUTSIDE DISPLAY AREA AND DRIVING METHOD FOR SAME PANEL

[75] Inventors: Yoshikazu Kanazawa; Fumitaka Asami, both of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,111

[22] Filed: Aug. 5, 1997

[30] Foreign Application Priority Data

Mar. 3, 1997 [JP] Japan ..... 9-047892

[51] Int. Cl.[7] ..... G09G 3/28

[52] U.S. Cl. ..... 345/60; 345/68; 315/169.1; 315/169.4; 315/168

[58] Field of Search ..... 315/169.4, 169.1, 315/168; 345/60, 68

[56] References Cited

U.S. PATENT DOCUMENTS

| | | | |
|---|---|---|---|
| 5,150,011 | 9/1992 | Fujieda | 315/169.4 |
| 5,369,338 | 11/1994 | Kim | 315/169.4 |
| 5,446,344 | 8/1995 | Kanazawa | 315/169.4 |
| 5,654,728 | 8/1997 | Kanazawa et al. | 345/68 |
| 5,677,600 | 10/1997 | Takahashi et al. | 315/169.4 |
| 5,818,175 | 8/1998 | Yoshioka et al. | 315/169.4 |
| 5,835,072 | 11/1998 | Kanazawa | 345/60 |
| 5,854,540 | 12/1998 | Matsumoto et al. | 315/169.1 |

FOREIGN PATENT DOCUMENTS

| | | |
|---|---|---|
| 4-312742 | 11/1992 | Japan . |
| 8-96714 | 4/1996 | Japan . |
| 9-160525 | 6/1997 | Japan . |

*Primary Examiner*—William A. Cuchlinski, Jr.
*Assistant Examiner*—Marthe Y. Marc-Coleman
*Attorney, Agent, or Firm*—Staas & Halsey LLP

[57] ABSTRACT

A plasma display panel and driving method thereof perform addressing at a high speed and a low voltage without deteriorating contrast. Priming electrodes forming priming cells are located outside but adjacent a display area. Glow occurring in the priming cells is intercepted. When priming discharge is induced at a reset step, voltages lower than a discharge start voltage are applied to first (X) and second (Y) electrodes and third (address) electrodes respectively. Despite the voltages being lower than the discharge start voltage, once discharge is induced in the priming cells, discharge starts in adjoining cells. The discharge then spreads successively over all the cells, thus inducing discharge in all the cells. Consequently, wall charge is produced in all the cells.

44 Claims, 19 Drawing Sheets

PLASMA DISPLAY PANEL HAVING DEDICATED PRIMING ELECTRODES OUTSIDE DISPLAY AREA AND DRIVING METHOD FOR SAME PANEL

BACKGROUND OF THE INVENTION

1. Field of the Invention

The present invention relates to an art of driving a display panel composed of a set of cells that are display elements having a memory function. More particularly, this invention is concerned with a driving method employed in writing display data in an alternating current (AC) type plasma display panel (PDP), and a panel in which the driving method is implemented.

A known display apparatus having a plasma display panel has three major problems as described below.

The first problem is a problem of invalid glowing occurring at a reset step. Full-screen writing discharge and full-screen self-erasure discharge have been used as a means for reset in the past. This known approach is adopted as a technique for neutralizing wall charge uniformly and stabilizing succeeding addressing discharge. Even in a full-screen erased state in which no display data is written, glowing takes place at a certain intensity. This leads to deteriorations of display contrast and display quality. Taking a known panel for instance, an amount of glow occurring at a reset step within each subfield reaches approximately 4 cd/$M^2$. A maximum gray-scale level attainable when cells are lit is approximately 200 cd/$m^2$. Thus, even in a dark room, the contrast is only 50:1.

The second problem lies in a voltage to be applied at an addressing step. For inducing addressing discharge, voltages that are higher than a discharge start voltage are applied to second electrodes and third electrodes respectively. It is therefore hard to minimize the power consumptions and breakdown voltages of a scan driver and address driver for driving electrodes independently. This leads to an increase in the cost of a display apparatus.

The third problem lies in the speed of addressing discharge. In a subfield method enabling gray-scale display, it is necessary to define many subfields within a predetermined time of one frame. It is essential to shorten an addressing period within each subfield which does not contribute to glowing. According to the known approach, discharge is induced in both X electrodes and Y electrodes using discharge occurring in addressing electrodes and Y electrodes as a trigger, thus forming wall charge needed for sustaining discharge. The time of 3 microseconds is therefore required for one addressing cycle. The number of lines that can be driven for a certain period of time and the number of subfields that can be defined therefor are therefore limited.

SUMMARY OF THE INVENTION

An object of the present invention is to realize a plasma display panel capable of being addressed at a high speed with a low voltage without deterioration of contrast, and a driving method to be implemented in the plasma display panel.

According to a plasma display panel of the present invention and a driving method for the plasma display panel, priming electrodes used to form priming cells are located outside a display area, and glow emanating from the priming cells is intercepted. For carrying out priming discharge at a reset step, voltages lower than a discharge start voltage are applied to first (X) and second (Y) electrodes and third (address) electrodes respectively. Even with voltages lower than the discharge start voltage, when the priming cells discharge, adjoining cells start discharging. Discharge spreads over all cells successively. Eventually, all the cells discharge. Thus, wall charge is produced in all the cells.

According to a plasma display panel of the present invention and a driving method for the plasma display panel, when priming discharge is carried out at a reset step, priming electrodes located outside a display area discharge. For inducing the discharge, it is necessary to apply voltages higher than a discharge start voltage in the same manner as it is according to the prior art. Glow stemming from this discharge is bright glow but does not affect display because it is intercepted. With the discharge of the priming electrodes as priming, discharge spreads successively over first and second electrodes and third electrodes within the display area. However, since discharge occurring in an adjoining area is used as priming, although voltages applied to the first and second electrodes and the third electrodes respectively are lower than the discharge start voltage, the discharge occurs. More particularly, the voltages are smaller than the discharge start voltage and equal to or larger than a minimum sustaining voltage to be applied at a sustaining discharge step. The range of glow stemming from the discharge is therefore smaller than that of glow occurring when voltages higher than the discharge start voltage are applied as they are according to the prior art. Deterioration of display contrast is limited.

The priming electrodes are formed parallel to the first and second electrodes on one side or both sides of the display area in a direction or directions perpendicular to the first and second electrodes outside the display area. One or two lines of priming cells are formed adjacently to the first display line and last display line.

When there are two lines of priming cells, if a driving method adopting the concept that one display frame is composed of a plurality of subfields is employed, a line on which priming discharge is performed should preferably be changed between two lines subfield by subfield. Consequently, it can be prevented that charge of one polarity alone is excessively produced in priming cells constituting one line alone.

When there are two lines of priming cells, priming discharge may be performed on the two lines simultaneously. Consequently, priming is provided simultaneously by the upper and lower lines of priming cells. Discharge spreads over the whole surface quickly. Wall charge can be produced in all the cells for a short period of time.

One priming electrode is a pair of adjoining parallel electrodes or a single electrode.

When a priming electrode is a single electrode, priming discharge is carried out in the priming electrode and in an adjoining first or second electrode, or the third electrodes. When priming discharge is carried out in the priming electrode and in the third electrodes (address electrodes), a high voltage should be applied to the priming electrode alone. This results in the simplified configuration of a complex address driver. A pulse to be applied to the priming electrode is of the same polarity as a voltage applied to the first and second electrodes forming display cells. Wall charge of the same polarity as charge in the display cells can be produced in the priming cells. Addressing discharge of the first line and last line can be stabilized.

Sustaining discharge is carried out by applying a voltage to the first (X) electrodes and to the second (Y) electrodes. The first electrodes and second electrodes are therefore referred to as sustaining discharge electrodes. When priming discharge is carried out in the priming electrode and an adjoining sustaining discharge electrode, the priming discharge can be carried out efficiently without the necessity of imposing a load on a drive circuit for driving the address electrodes. This is because since priming discharge is executed by applying a voltage pulse, the polarity of which is opposite to the polarity of a given voltage applied to the sustaining discharge electrode forming display cells, the absolute value of the applied voltage is small.

When a priming electrode is formed with a pair of adjoining parallel electrodes, a voltage to be applied to the priming electrodes can be set independently of a voltage to be applied to display cells. Priming discharge can be carried out more reliably.

In the case of a driving method adopting the concept that one display frame is composed of a plurality of subfields, the polarity of a voltage to be applied to a pair of priming electrodes should preferably be reversed, subfield by subfield. Thereby, immediately before the next subfield starts, the charge accumulated in the priming cells need not be erased but can be used for priming discharge as it is. An applied voltage can therefore be lowered.

When priming discharge is carried out at a reset step, the same voltage is applied to the first and second electrodes, and given voltages are applied to the third electrodes and the first and second electrodes respectively. Since the first and second electrodes have the same potential, homogeneous charge is produced in the cells arranged on a surface-discharge side.

The third electrodes are grounded, and wall charge is produced by applying the same voltage of positive polarity (for example, the same voltage as the voltage of a sustaining discharge pulse) to the first and second electrodes. Addressing discharge is then carried out using a pulse of opposite polarity. In this case, the wall charge reacts effectively. Discharge can therefore be induced with a low voltage. This discharge involves the third (address) electrodes and second (Y) electrodes, and therefore requires only a short time.

For driving a plasma display panel to which the present invention is adapted, since the third electrodes are grounded at a sustaining discharge step, wall charge remaining in cells that are turned OFF helps lower an applied voltage. Consequently, excess discharge will not occur.

When erasure discharge is carried out at the end of a sustaining discharge step, priming discharge and formation of wall charge can be achieved stably during the next subfield. In this case, when a voltage pulse whose polarity is opposite to the polarity of a voltage applied to the first and second electrodes at a reset step is applied, erasure discharge is performed even on cells on which sustaining discharge is not performed. Priming discharge and formation of wall charge can be achieved stably during the next subfield.

At the end of a sustaining discharge step, the third electrodes are grounded, and erasure discharge is carried out by applying a pulse of negative polarity to one or both of the first and second electrodes. Thereby, the erasure discharge can be carried out stably. Priming discharge and formation of wall charge can be achieved stably during the next subfield.

Furthermore, when the last sustaining discharge pulse is applied at a sustaining discharge step, a voltage of positive polarity capable of retaining, i.e., maintaining, the first and second electrodes and the third electrodes at the same potentials is applied immediately after occurrence of discharge, and the applied state is retained for a given period of time. Thereby, the same wall charge as the wall charge present in cells on which sustaining discharge is not performed can be produced in cells in which discharge has occurred. Consequently, the next operation can be performed uniformly on all the cells.

Furthermore, immediately after the last sustaining discharge pulse is applied at a sustaining discharge step, a state in which a voltage is applied to the first and second electrodes is retained. The voltage is equal to the voltage of the sustaining discharge pulse.

Furthermore, after a sustaining discharge step is completed, a pulse whose polarity is opposite to the polarity of a voltage applied at a reset step is applied to discharge all the cells. Thereby, the next priming discharge or formation of wall charge can be achieved stably.

A priming electrode drive circuit for driving priming electrodes is located independently of drive circuits for driving the other electrodes. Known drive circuits can be used for driving the other electrodes as they are. The priming electrode drive circuit is formed with a switching circuit having at least one pair of push-pull circuits.

BRIEF DESCRIPTION OF THE DRAWINGS

The present invention will be more clearly understood from the description as set below with reference to the accompanying drawings, wherein.

DESCRIPTION OF THE PREFERRED EMBODIMENTS

Figure 1:
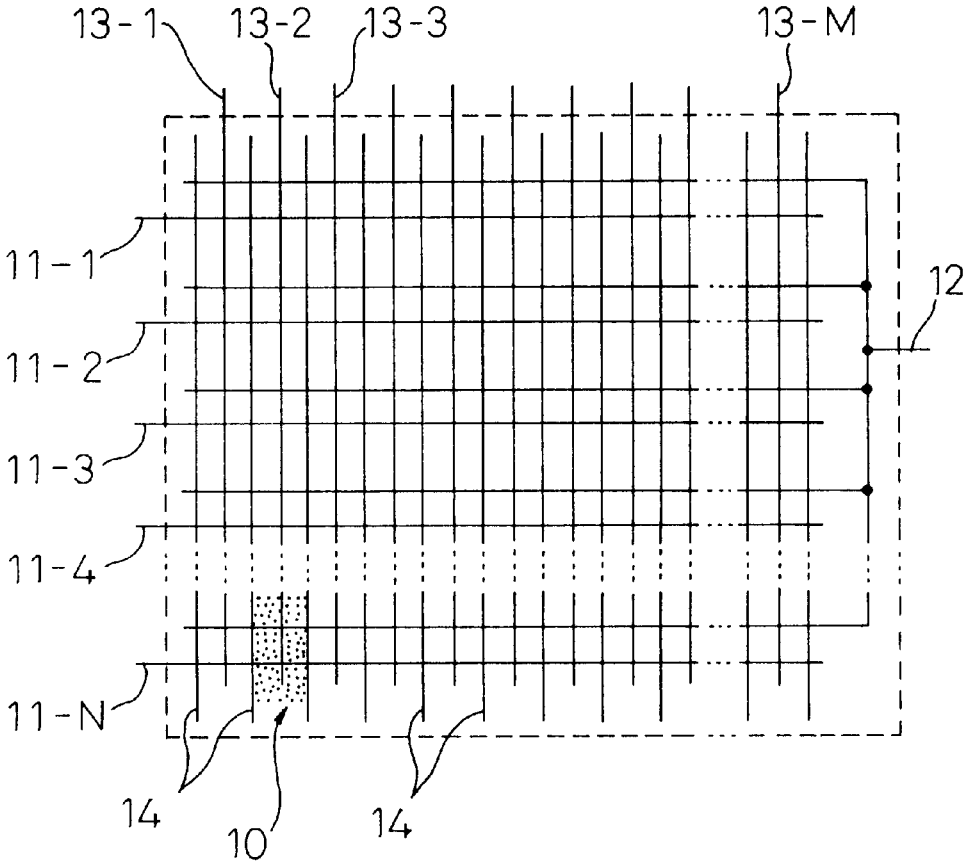
FIG. 1 is a schematic plan view of a known triple-electrode surface-discharge AC type PDP.

Before proceeding to a detailed description of the preferred embodiments of the present invention, a prior art plasma display apparatus will be described with reference to the accompanying drawings relating thereto for a clearer understanding of the differences between the prior art and the present invention.

An AC type PDP is designed to sustain discharge by applying a voltage wave alternately to two sustaining electrodes, and to thus glow for display. One discharge lasts one to several microseconds immediately after application of a pulse. Ions that are a positive charge stemming from discharge are accumulated on the surface of an insulating layer coated over electrodes to which a negative voltage is applied. Likewise, electrons that are a negative charge are accumulated on the surface of the insulating layer coated over electrodes to which a positive voltage is applied.

A pulse (writing pulse) of a high voltage (writing voltage) is applied first in order to induce discharge. After wall charge is produced, when a pulse (sustaining pulse or sustaining discharge pulse) of a voltage of opposite polarity that is lower than the previous voltage (sustaining voltage or sustaining discharge voltage) is applied, the wall charge accumulated previously is superposed on the voltage. The voltage working on a discharge space thus becomes larger and eventually exceeds a threshold value of a discharge voltage. This causes discharge to start. In other words, cells on which writing discharge is performed once and in which wall charge is produced are characterized by the fact that discharge is sustained when a sustaining pulse is applied with the polarity thereof reversed alternately. This is referred to as a memory effect or memory function. In general, an AC type PDP is intended to achieve display by utilizing the memory effect.

In an AC type PDP designed for full-color display, a triple-electrode structure realized by utilizing surface discharge is generally adopted. The triple-electrode structure is divided into a type in which third electrodes are formed on a substrate on which first and second electrodes capable of sustaining discharge are arranged, and a type in which the third electrodes are arranged on another opposed substrate. Moreover, the type in which three kinds of electrodes are formed on the same substrate is divided into a type in which the third electrodes are arranged on the two kinds of electrodes capable of sustaining discharge, and a type in which the third electrodes are arranged under the two kinds of sustaining discharge electrodes. Furthermore, there are a type (transmission type) in which visible light emanating from phosphors is seen through the phosphors, and a type (reflection type) in which light reflected from the phosphors is seen. Moreover, the spatial couplings of cells, in which discharge occurs, with adjoining cells are disconnected by ribs or barriers. The ribs may be arranged on four sides to enclose each discharge cell so that each discharge cell can be fully sealed. Alternatively, the ribs may be arranged unidirectionally. In this case, couplings with cells on the other sides are disconnected by optimizing gaps (distances) among electrodes.

This specification describes the present invention by taking for instance a reflection type panel in which third electrodes are formed on another substrate opposed to a substrate on which electrodes capable of sustaining discharge are arranged, ribs are formed only in a vertical direction (that is, orthogonally to first electrodes and second electrodes and parallel to third electrodes), and part of sustaining electrodes are formed with transparent electrodes.

Figure 2:
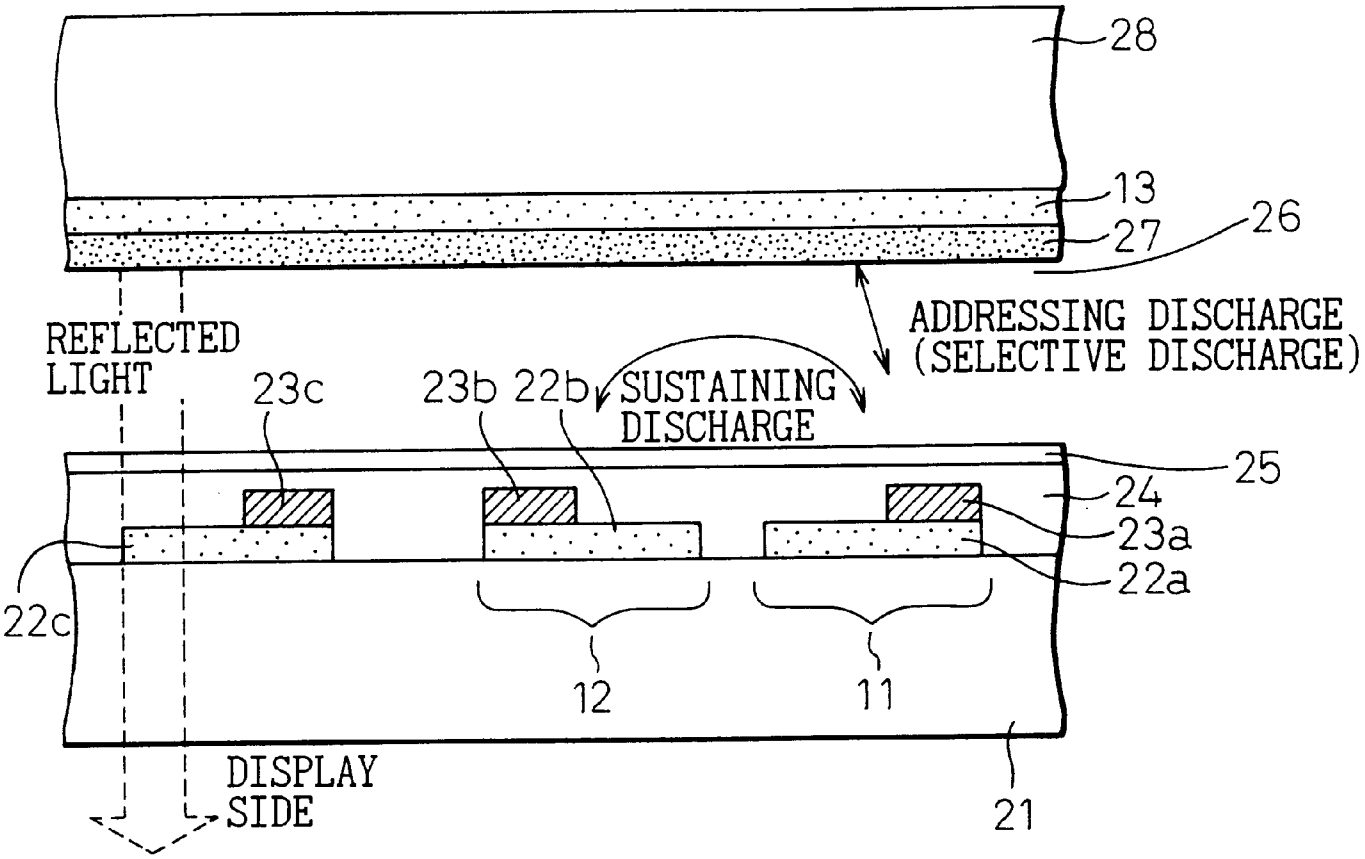
FIG. 2 is a schematic sectional view of the known triple-electrode surface-discharge AC type PDP.

As the aforesaid triple-electrode surface-discharge type PDP, what is shown in the schematic plan view of FIG. 1 is known. FIG. 2 is a schematic sectional view of the panel, and FIG. 3 is a schematic sectional view showing a section in a horizontal direction of the panel.

The panel is composed of two glass substrates 21 and 28. The first substrate 21 has first and second electrodes (X electrodes and Y electrodes) 12 and 11 that are parallel sustaining electrodes. These electrodes are composed of transparent electrodes 22*a* and 22*b* and bus electrodes 23*a* and 23*b*. The transparent electrodes transmit light reflected from phosphors. A metal is made into the bus electrodes in an effort to prevent a voltage drop caused by an electrode resistance. The electrodes are covered with a dielectric layer 24. A magnesium oxide (MgO) film 25 is formed as a protective film on a discharge side of the first substrate. On the second substrate 28 opposed to the first glass substrate 21, third electrodes (address electrodes) 13 are formed orthogonally to the sustaining electrodes 11 and 12. Ribs 14 are formed among the address electrodes 13. Phosphors 27 having properties of glowing in red, green, and blue are formed among the ribs 14 so that the phosphors can shield the address electrodes 13. The two glass substrates are assembled by bringing the ridges 14 of the ribs into contact with the MgO surface 25.

Figure 3:
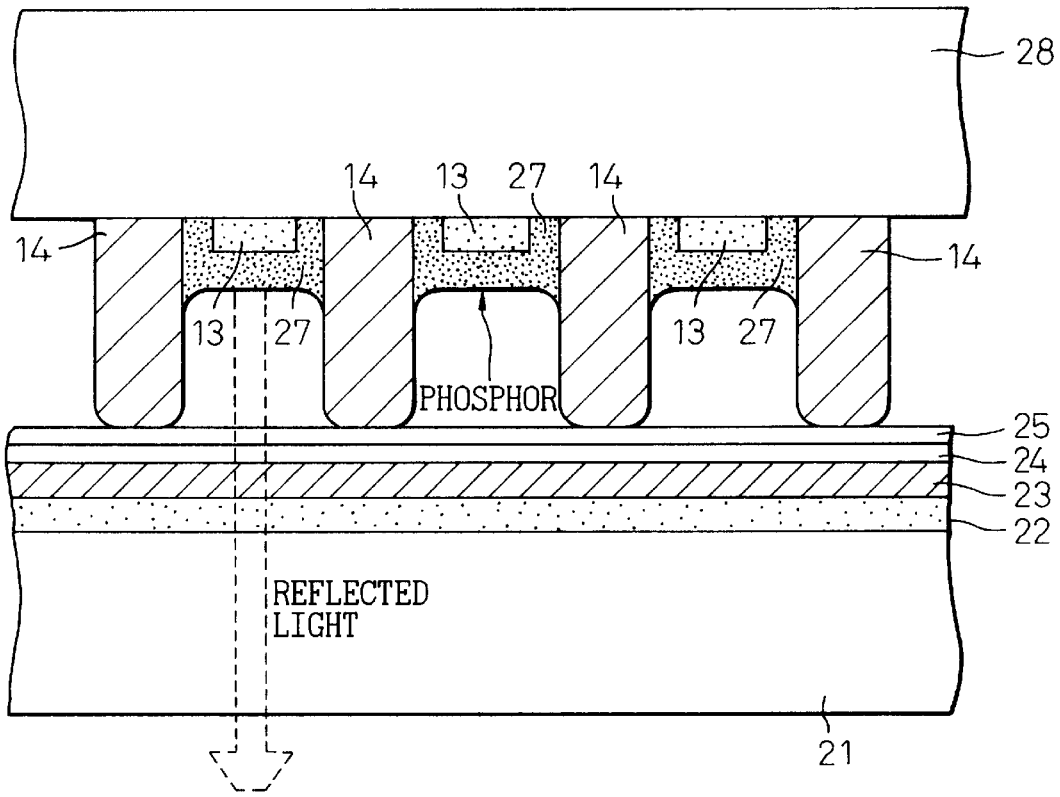
FIG. 3 is a schematic sectional view of the known triple-electrode surface-discharge AC type PDP.
Figure 4:
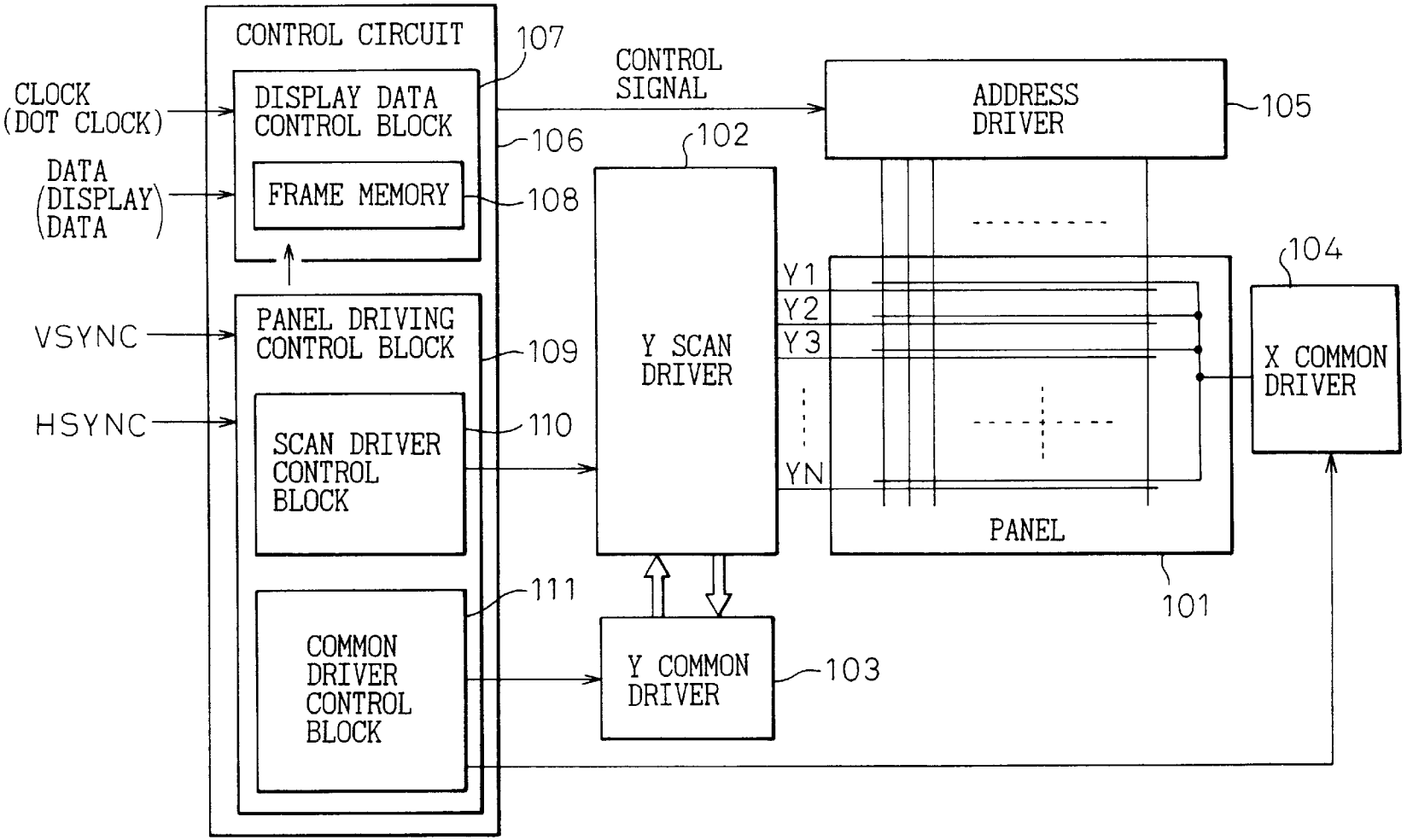
FIG. 4 is a schematic block diagram of a known PDP display apparatus.

FIG. 4 is a schematic block diagram showing peripheral circuits for driving the PDP shown in FIGS. 1, 2, and 3. The address electrodes 13 are connected one by one to an address driver 105. The address driver applies an addressing pulse for addressing discharge. The Y electrodes 11 are connected independently to a scan driver 102. A Y common driver 103 for producing a sustaining discharge pulse and applying it to the Y electrodes is connected to the scan driver 102. A scanning pulse to be applied during addressing discharge is generated by the scan driver 102. A sustaining pulse or the like is generated by the Y common driver 103, and applied to the Y electrodes 11 via the scan driver 102. The X electrodes 12 coincident with all display lines in the panel are connected in common. An X common driver 104 generates a writing pulse, sustaining pulse, and the like. These drivers are controlled by a control circuit 106. The control circuit is controlled with synchronizing signals CLOCK, VSYNC, and HSYNC and a display data signal DATA which are input externally of the display apparatus.

Figure 5:
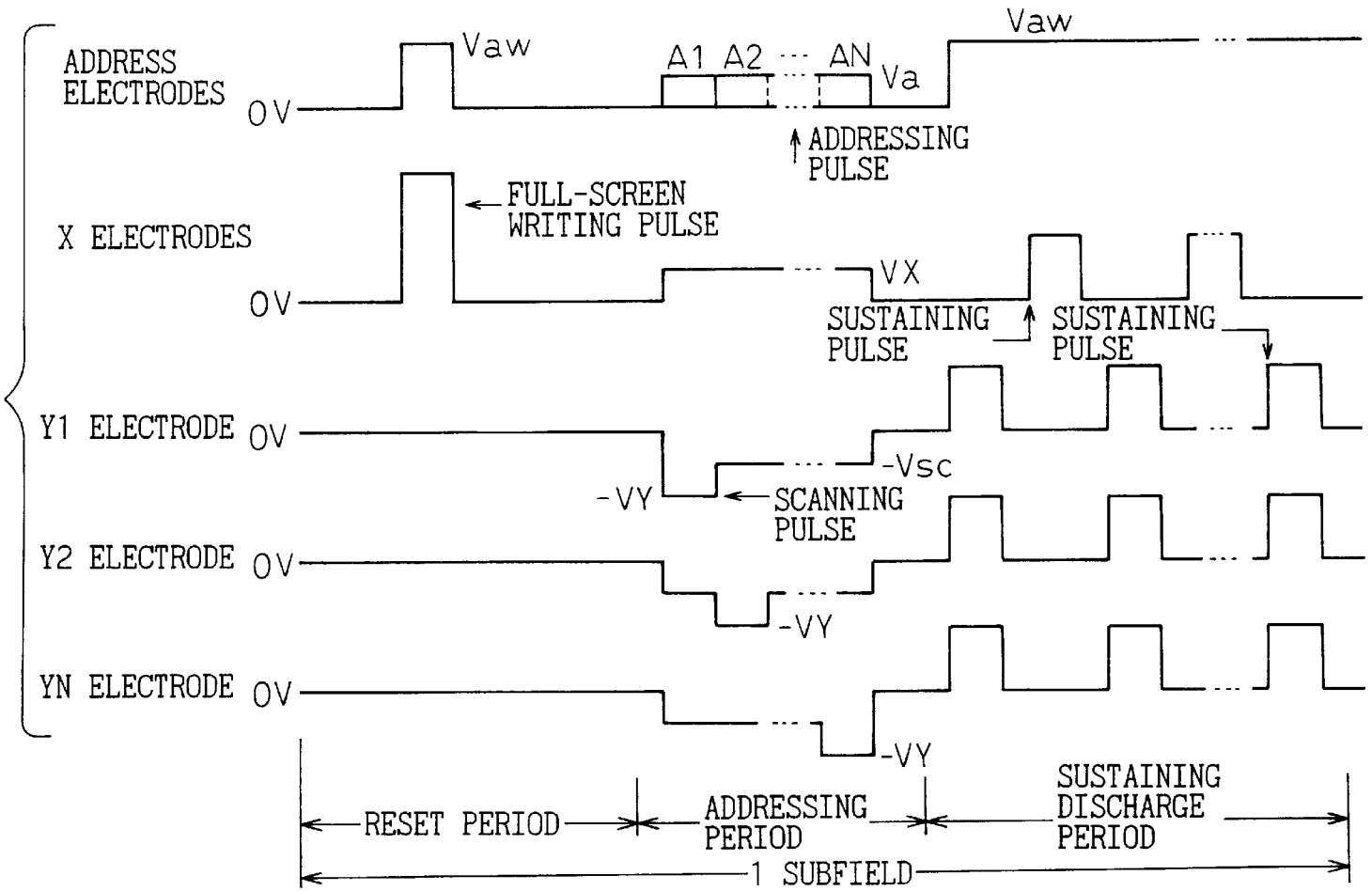
FIG. 5 is a waveform chart concerning a known driving method.

FIG. 5 is a waveform chart concerning a known driving method in which the PDP shown in FIGS. 1 to 3 is driven by the circuits shown in FIG. 4, and illustrating one subfield whose concept is constructed in a so-called known "addressing/sustaining discharge separated type writing addressing method." In this example, one subfield is divided into a reset period, addressing period, and sustaining discharge period. During the reset period, first, all the v electrodes are set to 0 V. At the same time, a full-screen writing pulse of a voltage Vs+Vw (approximately 300 V) is applied to the X electrodes. All the display cells constituting all the display lines discharge irrespective of their previous display states. The potential at the address electrodes at this time is approximately 100 V (Vaw). Thereafter, the potentials at the X electrodes and address electrodes are set to 0 V. In all the cells, a voltage developing with a wall charge exceeds a discharge start voltage. A discharge starts. The discharge ceases eventually because, since there is no potential difference among the electrodes, a space charge neutralizes itself. This is so-called self-erasure discharge. The self-erasure discharge brings all the cells in the panel to a uniform state in which no wall charge is present. The reset period is helpful in bringing all the cells to the same state irrespective of I5 the lit or unlit states of the cells during the previous subfield, and in stabilizing the next addressing (writing) discharge.

Thereafter, during the addressing period, addressing discharge is carried out line-sequentially in order to turn ON or OFF the cells according to display data.

First, a scanning pulse of a −VY level (approximately −150 V) is applied to a Y electrode. An addressing pulse of a voltage Va (approximately 50 V) is applied selectively to address electrodes forming cells in which discharge is sustained, that is, cells to be lit among all the address electrodes. Consequently, discharge occurs in the address electrodes and Y electrode forming the cells to be lit. The discharge works as priming, and immediately causes the X electrode and Y electrode to discharge. Wall charge is then accumulated on the MgO surface over the X electrode and Y electrode coincident with the selected cells on a selected line to an amount permitting sustaining discharge.

The same operation is performed on the other display lines successively. The new display data is thus written on all the display lines.

Thereafter, during the sustaining discharge period, a sustaining pulse of a voltage Vs (approximately 180 V) is applied alternately to the Y electrodes and X electrodes. Discharge is thus sustained, and an image of one subfield is displayed. In the "addressing/sustaining discharge separated type writing addressing method," a luminance level is determined with the length of the sustaining discharge period, that is, the number of sustaining pulses.

Figure 6:
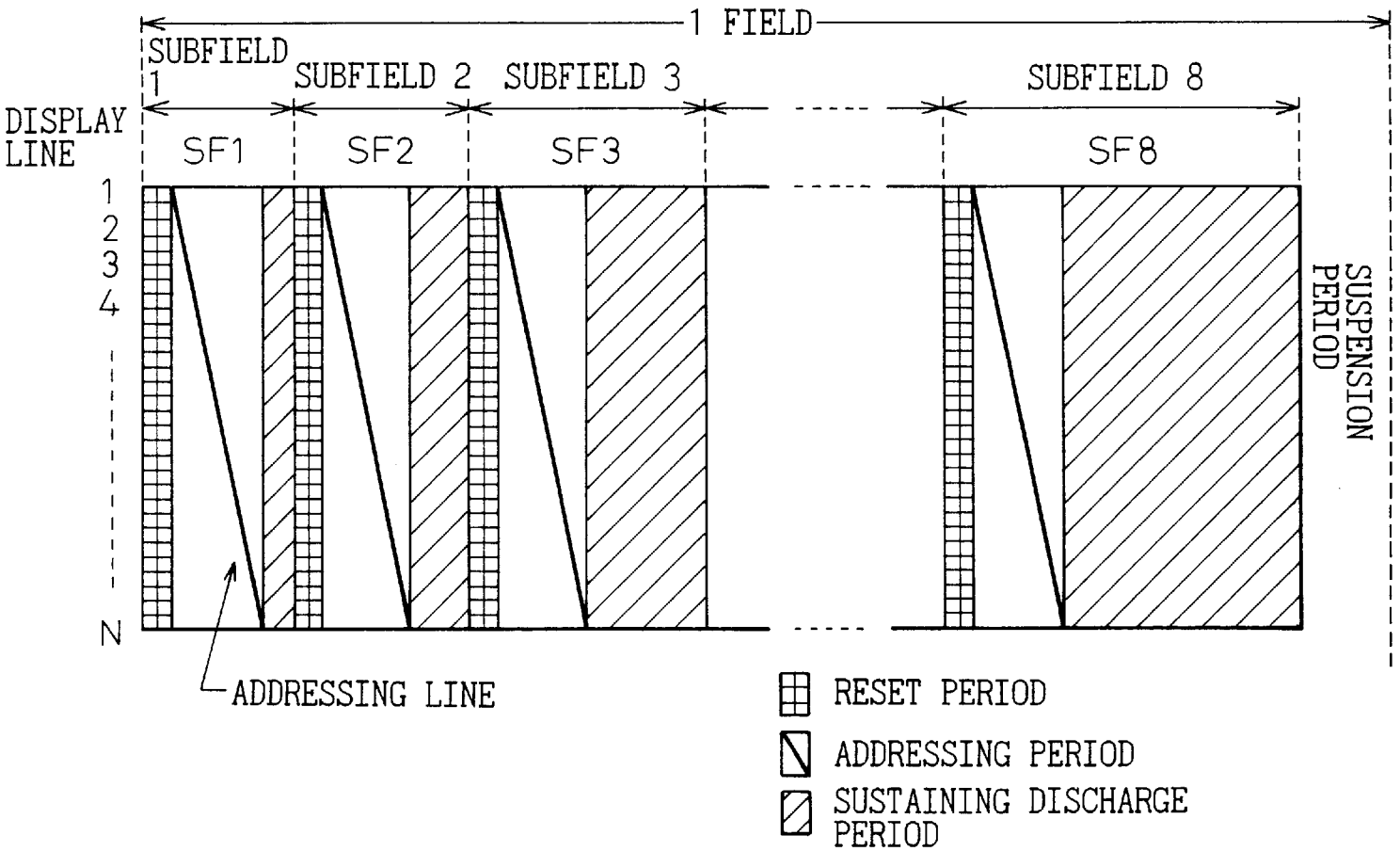
FIG. 6 is a diagram showing a sequence for gray-scale display.

To be more specific, a driving method to be adopted for 256-level gray-scale display is shown as an example of multilevel gray-scale display in FIG. 6. In this example, one field is divided into eight subfield SF1, SF2, SF3, SF4, SF5, SF6, SF7, and SF8.

The reset periods and addressing periods within the subfields SF1 to SF8 have the same lengths. Moreover, the ratio of the lengths of the sustaining discharge periods is 1:2:4:8:16:32:64:128. Depending on during which subfields cells are lit, differences in luminance can be expressed in the range of 256 levels ranging from level 0 to 255.

An example of actual time allocation is as follows:

assuming that rewriting of a screen is carried out at 60 Hz, one frame is 16.6 msec. (1/60 Hz). Assuming that the number of sustaining discharge cycles (sustaining cycles) within one frame is 510, the number of sustaining discharge cycles within subfield SF1 is 2, the number of sustaining discharge cycles within subfield SF2 is 4, the number of sustaining discharge cycles within subfield SF3 is 8, the number of sustaining discharge cycles within subfield SF4 is 16, the number of sustaining discharge cycles within subfield SF5 is 32, the number of sustaining discharge cycles within subfield SF6 is 64, the number of sustaining discharge cycles within subfield SF7 is 128, and the number of sustaining discharge cycles within subfield SF8 is 256. Assuming that the time required for a sustaining cycle is 8 microseconds, the total time of the sustaining cycles within one frame is 4.08 msec. The remaining approximately 12 msec. is allocated to eight reset periods and addressing periods. The reset period and addressing period within each subfield comes to approximately 1.5 msec. Assuming that about 50 microseconds is required for the reset period preceding the addressing period, an addressing cycle requires 3 microseconds for the purpose of driving a panel having 500 lines.

As mentioned above, a display apparatus having a known plasma display panel has three critical problems. The first problem is deterioration of contrast derived from invalid glowing occurring at a reset step, the second problem is that the voltage to be applied at an addressing step is high, and the third problem is that the time required for addressing discharge cannot be shortened.

Figure 7:
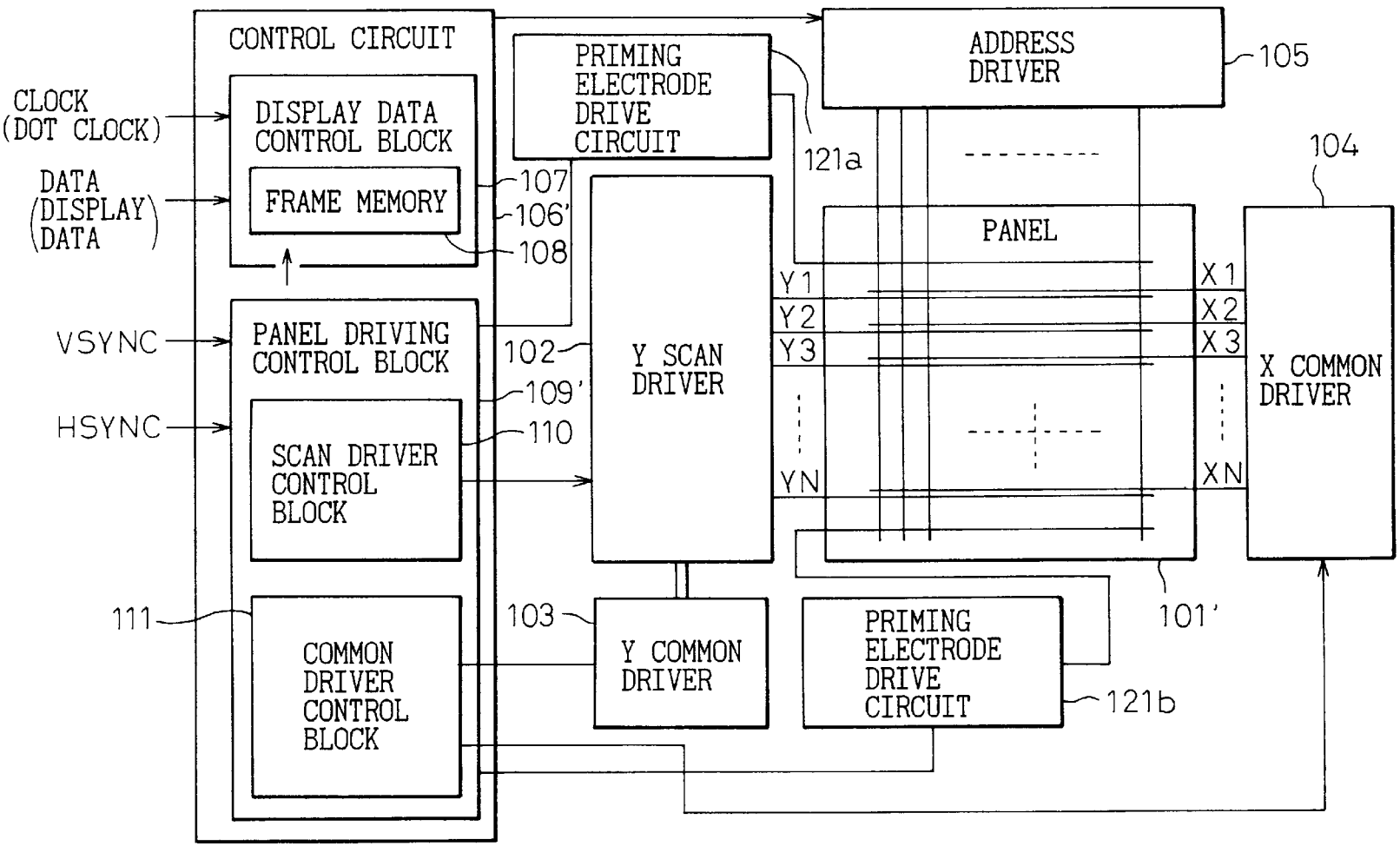
FIG. 7 is a diagram showing the configuration of a plasma display apparatus of a first embodiment of the present invention.

FIG. 7 is a diagram showing the configuration of a plasma display apparatus of the first embodiment of the present invention. As is apparent from comparison with the known apparatus shown in FIG. 4, a difference from the known apparatus lies in a point that priming electrodes are included in a plasma display panel 101', and priming electrode drive circuits 121*a* and 121*b* are included for driving the priming electrodes, and in a point that a control circuit 106' and panel driving control block 109' are modified accordingly. The other components are identical to those of the known apparatus.

Only the different points will be described below.

Figure 8:
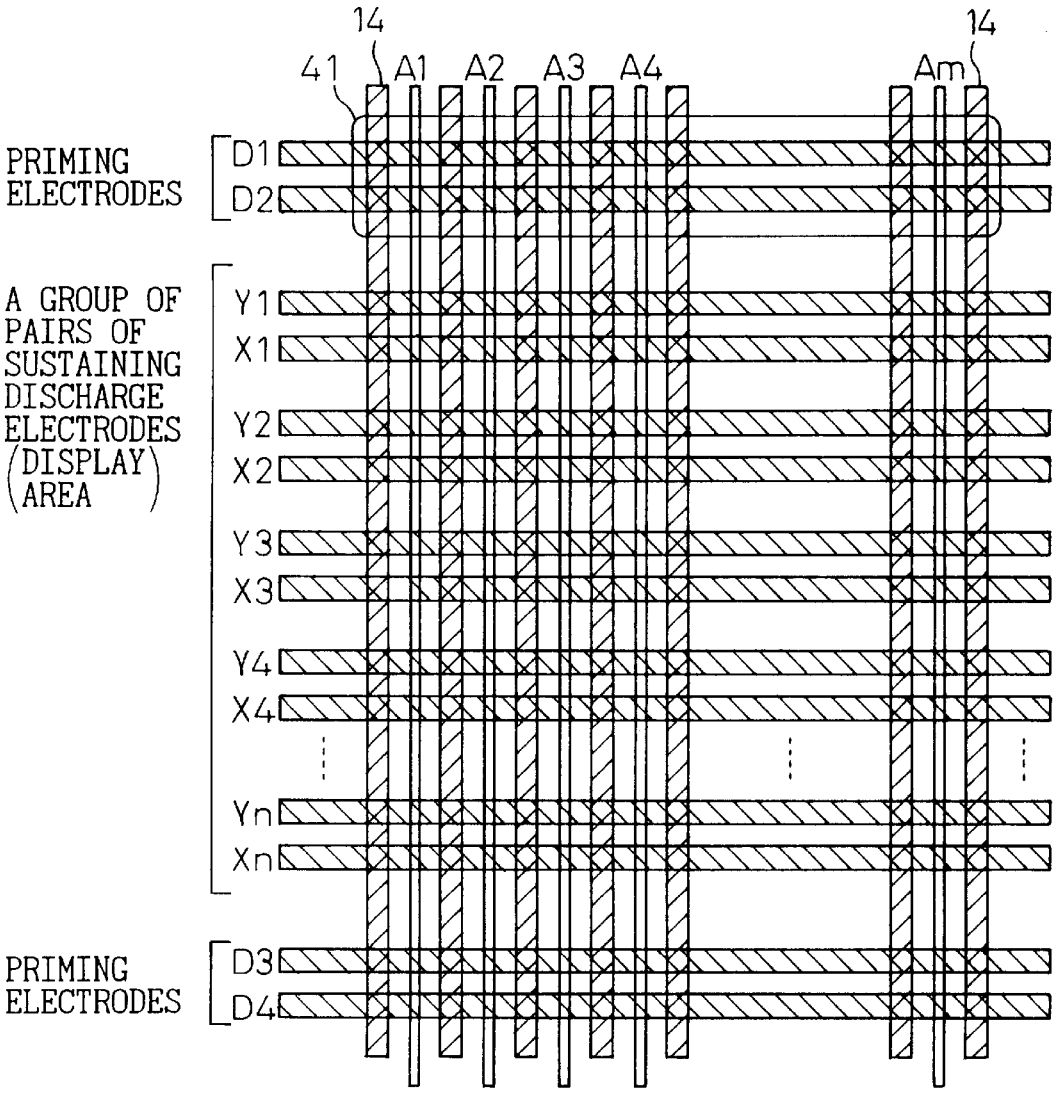
FIG. 8 is a diagram showing the structure of a panel in the first embodiment.
Figure 9:
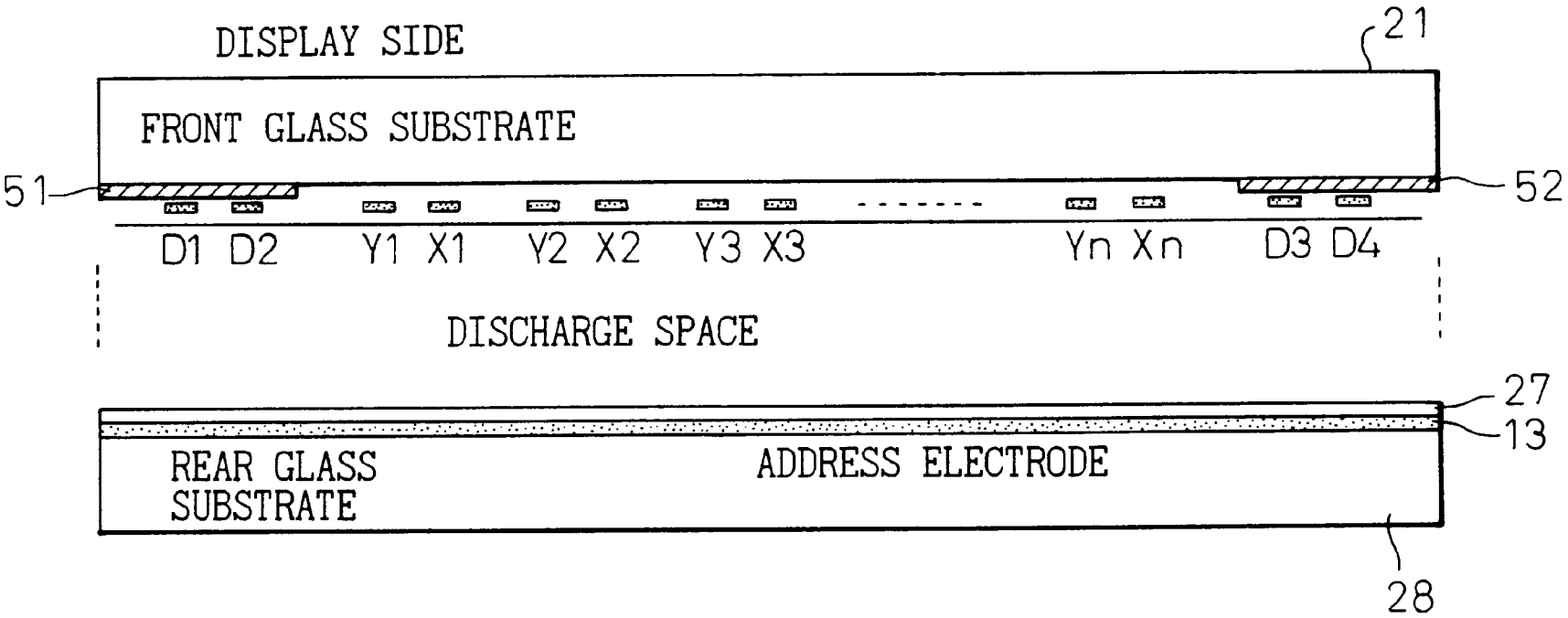
FIG. 9 is a sectional view of the panel in the first embodiment.

FIG. 8 is a diagram showing the structure of the plasma display panel 101' of the first embodiment, and FIG. 9 is a sectional view of the plasma display panel.

As shown in FIGS. 8 and 9, two priming electrodes D1 and D2 are located parallel to the sustaining discharge electrodes adjacent to the upper side of second electrode (Y electrode) Y1 that is one of the sustaining discharge electrodes on the first display line. Two priming electrodes D3 and D4 are located parallel to the sustaining discharge electrodes adjacently to the lower side of first electrode (X electrode) Xn that is one of the sustaining discharge electrodes on the last display line. The priming electrodes D1 to D4 are placed on the front glass substrate like the X electrodes and Y electrodes serving as the sustaining discharge electrodes. Priming discharge carried out by applying voltages to priming electrodes D1 and D2 involves an area 41 in FIG. 8. The same applies to discharge induced in priming electrodes D3 and D4. Light-interceptive members 51 and 52 are located near priming electrodes D1 and D2 and priming electrodes D3 and D4 respectively on the side of the display side of the front glass substrate. Glow stemming from priming discharge occurring in priming electrodes D1 and D2 or in priming electrodes D3 and D4 is invisible. Incidentally, the other components constituting each display cell are identical to those in the known apparatus.

Figure 10:
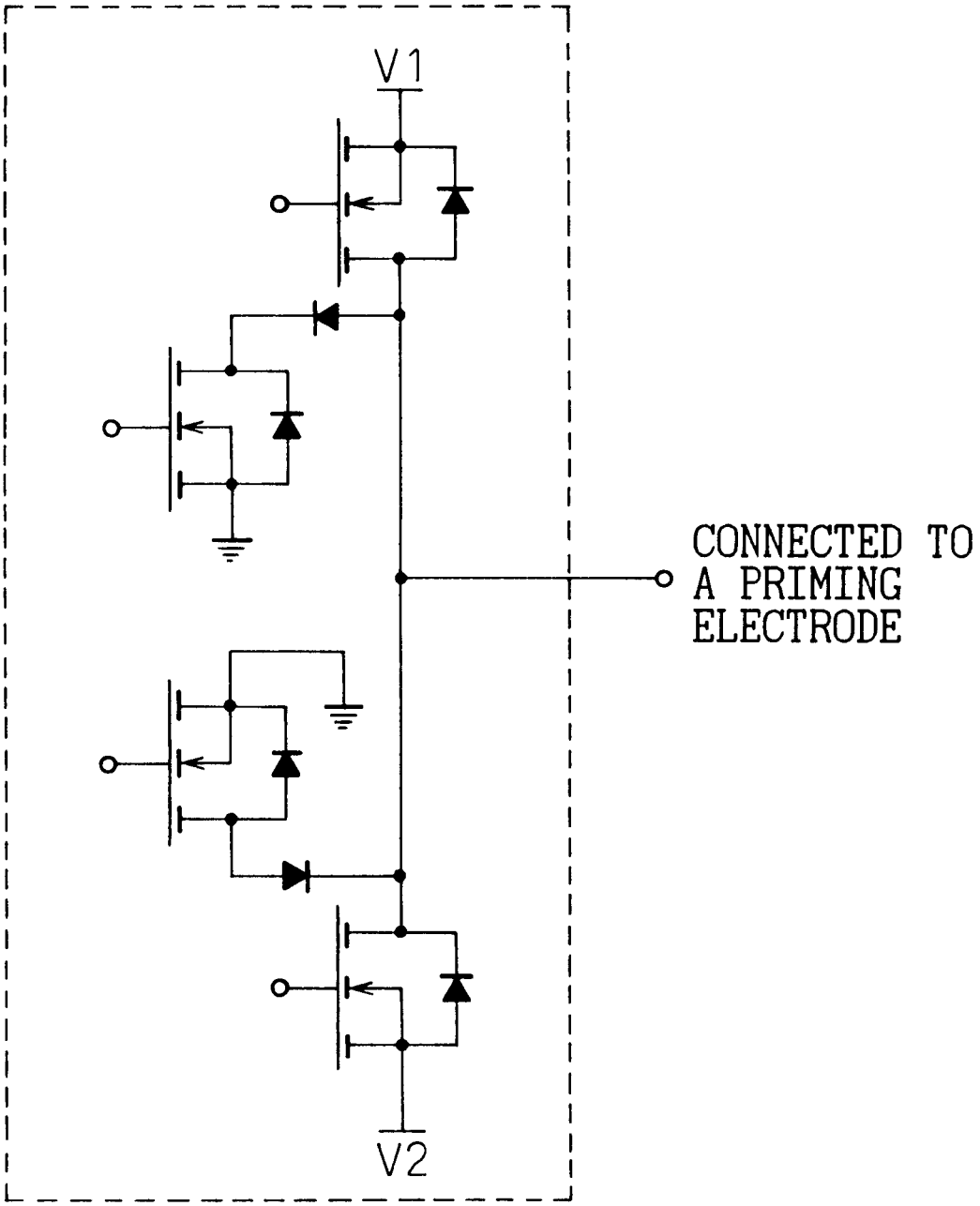
FIG. 10 is a diagram showing the circuitry of a priming electrode drive circuit in the first embodiment.

FIG. 10 is a diagram showing the circuitry of a drive circuit realizing each of the priming electrode drive circuits 121*a* and 121*b*. Such a circuit is associated with each priming electrode. The priming electrode drive circuit has the same circuitry as the X common driver 104 or the like, and is formed with a pair of switching elements each formed with a field-effect transistor (FET) having a push-pull configuration. By specifying a voltage to be applied to the gate of each FET, a voltage to be applied to a priming electrode can be selected from among a voltage V1, voltage V2, and ground level.

Figure 11:
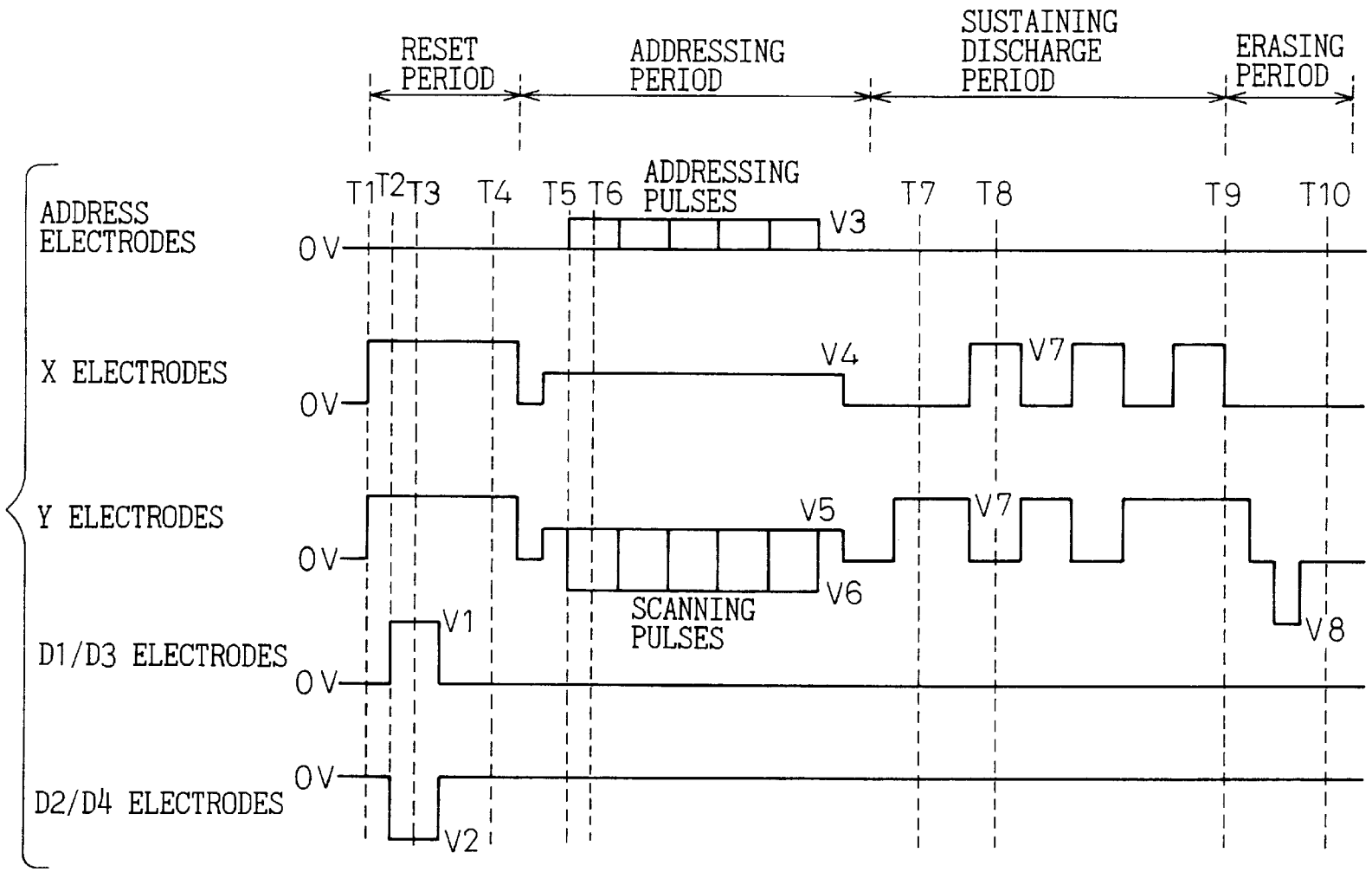
FIG. 11 is a waveform chart showing driving waves employed in the first embodiment.

FIG. 11 is a diagram showing driving waves to be applied to the electrodes in the first embodiment. FIGS. 12A to 12D, 13A and 13B, 14A and 14B, and 15 are sectional views showing the states of the panel resulting from application of the driving waves. These drawings show only the first display line and surroundings. The same applies to the last display line and surroundings. The description proceeds on the assumption that in the first embodiment, interlacing display in which every second display line is displayed during each frame is carried out. Referring to the drawings, the actions will be described.

Figure 12A:
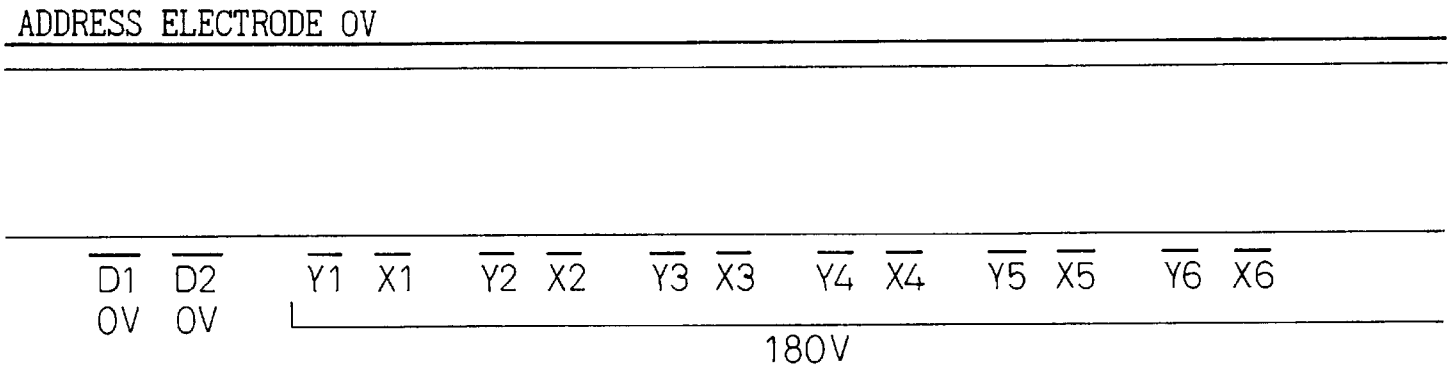
FIGS. 12A to 12D are explanatory diagrams of operations performed at a reset step in the first embodiment.
Figure 12B:
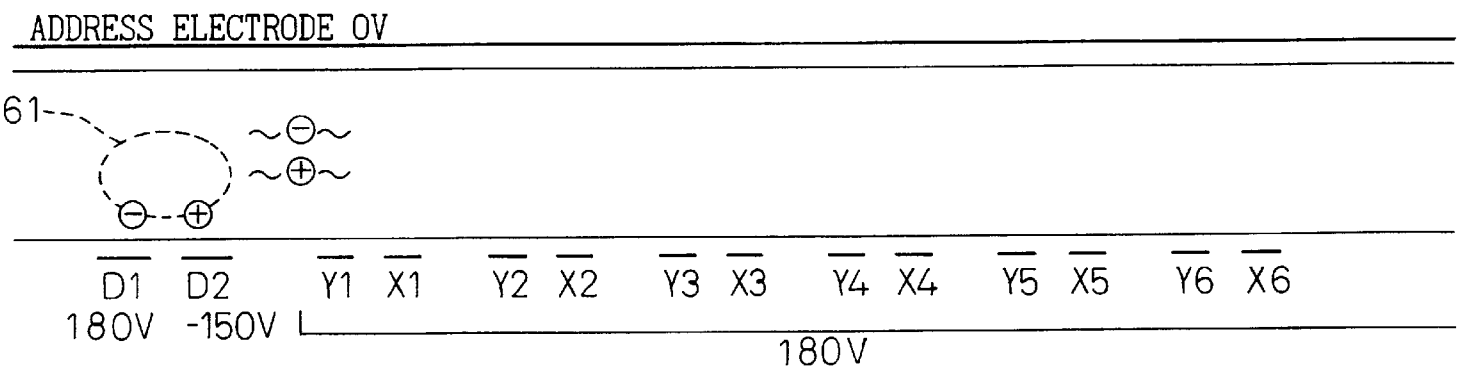
Figure 12C:
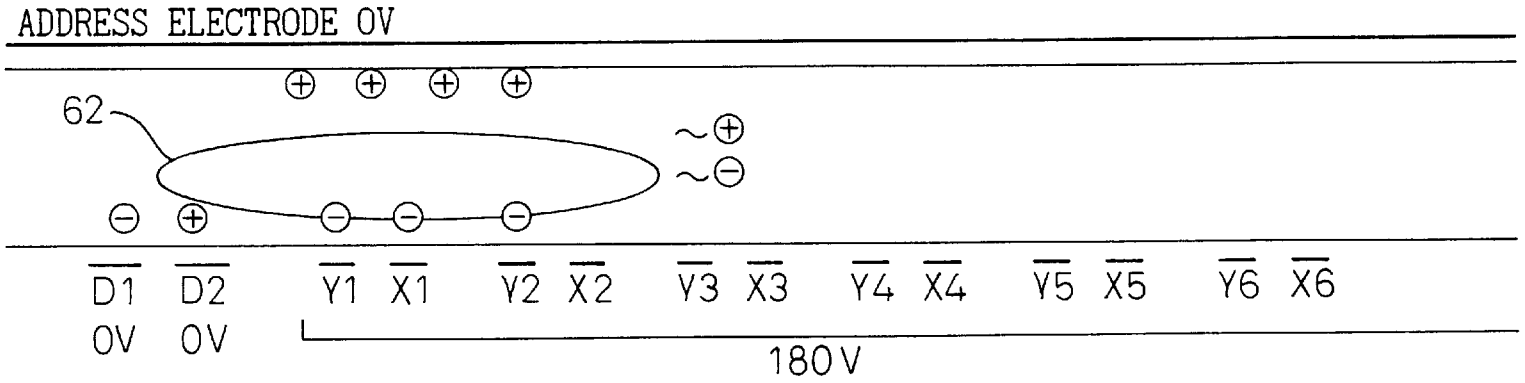
Figure 12D:
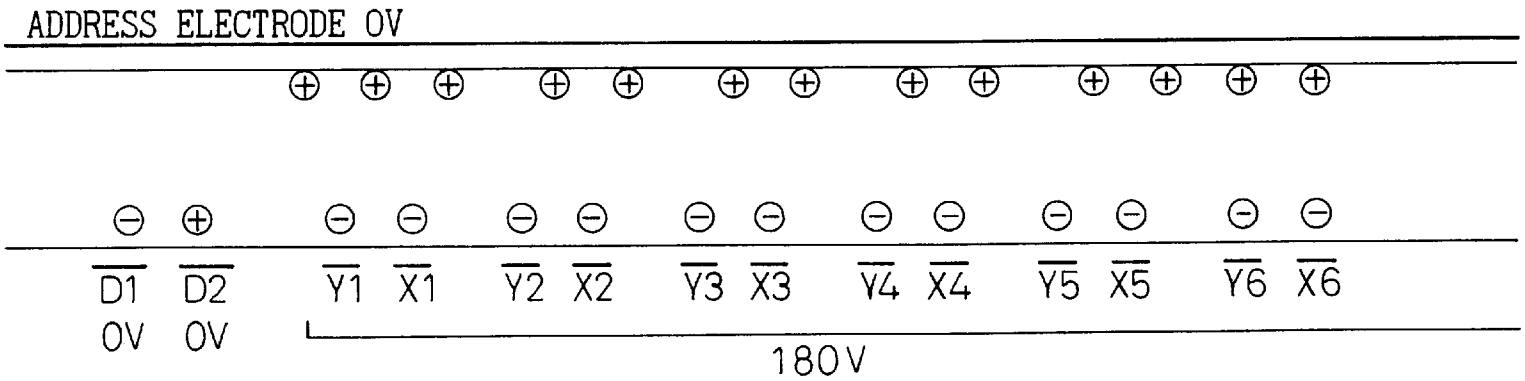

At a start time instant (T1) within a subfield, the address electrodes are set to 0 V, and a given voltage of a voltage V7 is applied to the X electrodes and Y electrodes. FIG. 12A shows the state of the panel at this time. Thereafter, at a time instant T2, as shown in FIG. 12B, voltages (V1+V2) larger than a discharge start voltage are applied to priming electrodes D1 and D2 and to priming electrodes D3 and D4. This brings about priming discharge 61. Glow stemming from the discharge is invisible because of the light-interceptive members 51 and 52. When the priming discharge 61 is carried out, as shown in FIG. 12C, discharge is induced in adjoining electrode Y1 and the address electrodes. Discharge is then induced continuously in adjoining electrode X1 and the address electrodes, in adjoining electrode Y2 and the address electrodes, etc. Thus, discharge spreads toward the center of the substrate (at a time instant T3). Meanwhile, similar priming discharge is carried out in priming electrodes D3 and D4. Discharge then spreads from the lower end of the substrate toward the center thereof. Thus, discharge spreads from both the upper and lower ends of the substrate. Eventually, discharge occurs in all the cells. Discharge must spread in vertical directions, and the ribs 13 must therefore have the structure shown in FIG. 8 so as to partition the cells solely sideways. The instant discharge occurs in all the cells, the voltages applied to priming electrodes D1 and D2 and to priming electrodes D3 and D4 are set to 0 V. This causes the discharge to cease. As a result of the discharge, positive wall charge is produced on the side of the address electrodes, and negative wall charge is produced on the side of the X electrodes and Y electrodes. This state of the panel is shown in FIG. 12D (at a time instant T4).

Figure 13A:
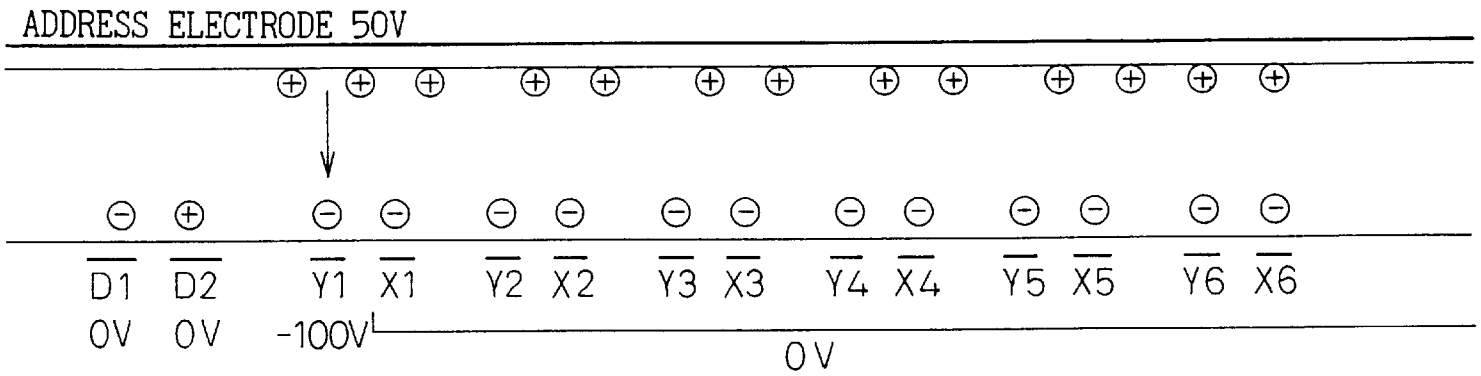
FIGS. 13A and 13B are explanatory diagrams of actions made at an addressing step in the first embodiment.
Figure 13B:
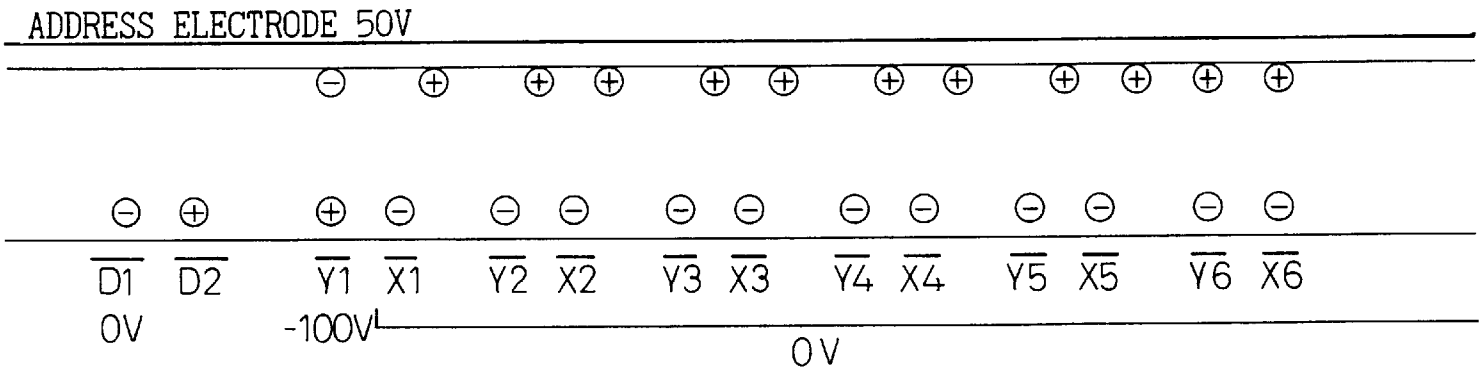

Thereafter, at an addressing step, the voltage applied to the X electrodes and Y electrodes is changed to 0 V. At a time instant T5, a scanning pulse of a voltage V6 is applied to electrode Y1, and an addressing pulse of a voltage V3 is applied selectively to the address electrodes. The state of the panel at this time is shown in FIG. 13A. A potential difference between the address electrodes and the Y electrode is much smaller than a discharge start voltage. A voltage developed by wall charge works effectively, thus inducing discharge. With this addressing discharge, wall charge on the Y electrode becomes positive. The discharge ceases at a time instant T6. The state of the panel at this time is shown in FIG. 13B. The application of the scanning pulse is carried out continuously up to the last Y electrode. The addressing discharge is then completed.

Figure 14A:
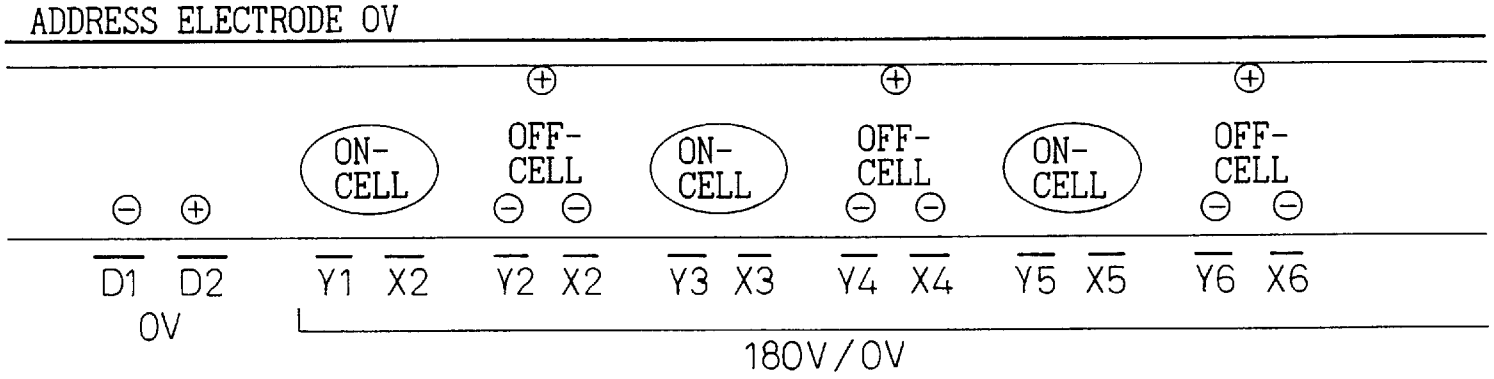
FIGS. 14A and 14B are explanatory diagrams of actions made at a sustaining discharge step in the first embodiment.
Figure 14B:
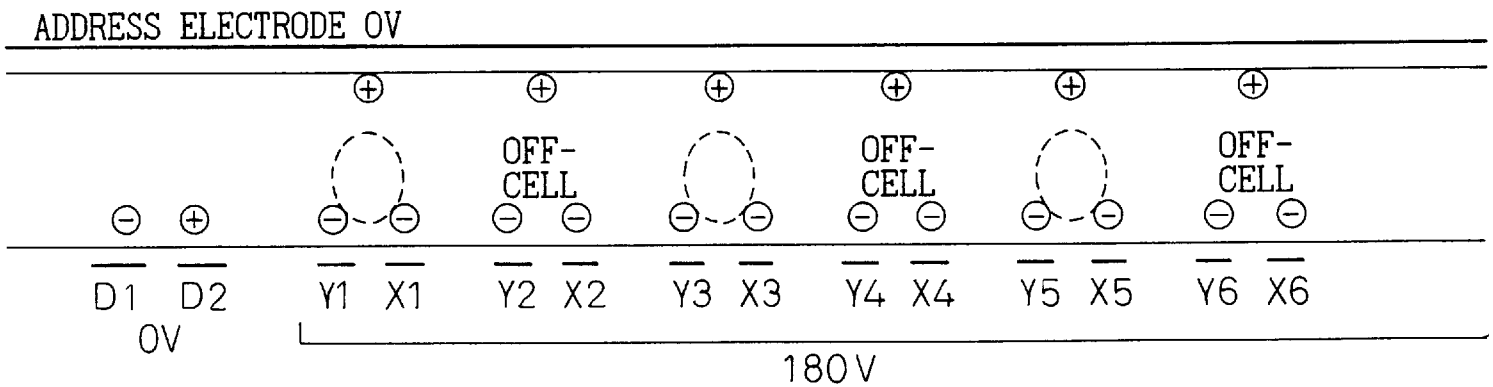

At a sustaining discharge step, a sustaining discharge pulse of a voltage V7 is applied alternately to the Y electrodes and X electrodes. In the cells on which addressing discharge is performed, sustaining discharge is repeated. The state of the panel at this time is shown in FIG. 14A. At a time instant T9 at which discharge is induced by the last sustaining discharge pulse, since the potentials at the X electrodes and Y electrodes are retained at the voltage V7, negative wall charge is produced on the side of the sustaining discharge electrodes. This state of the panel is shown in FIG. 14B.

Figure 15:
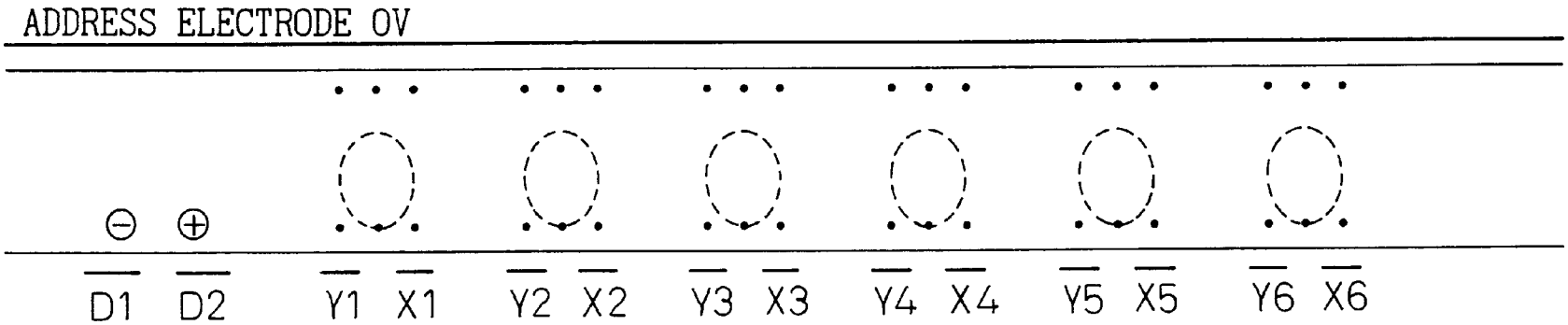
FIG. 15 is an explanatory diagram of actions made at an erasure step in the first embodiment.

At an erasure step, an erasing pulse of a voltage V8 of negative polarity is applied to the Y electrodes. Erasure discharge is then carried out uniformly in all the cells. The state of the panel at a time instant T10 at which the erasure discharge is completed is shown in FIG. 15.

During the next subfield, the voltages to be applied to priming electrodes D1 and D2 and to priming electrodes D3 and D4 are of opposite polarities. This obviates the necessity of erasing the wall charge in the priming cells.

By repeating the foregoing steps, glow display is achieved. The values of the aforesaid voltages are, for example, as follows: V1=V7=180 V, V2=−150 V, V3 (addressing voltage)=50 V, V4=V5=0 V, V6=−100 V, and V8=−150 V. The voltage values vary depending on the conditions for driving. Optimal values are determined under the respective conditions for driving.

Figure 16:
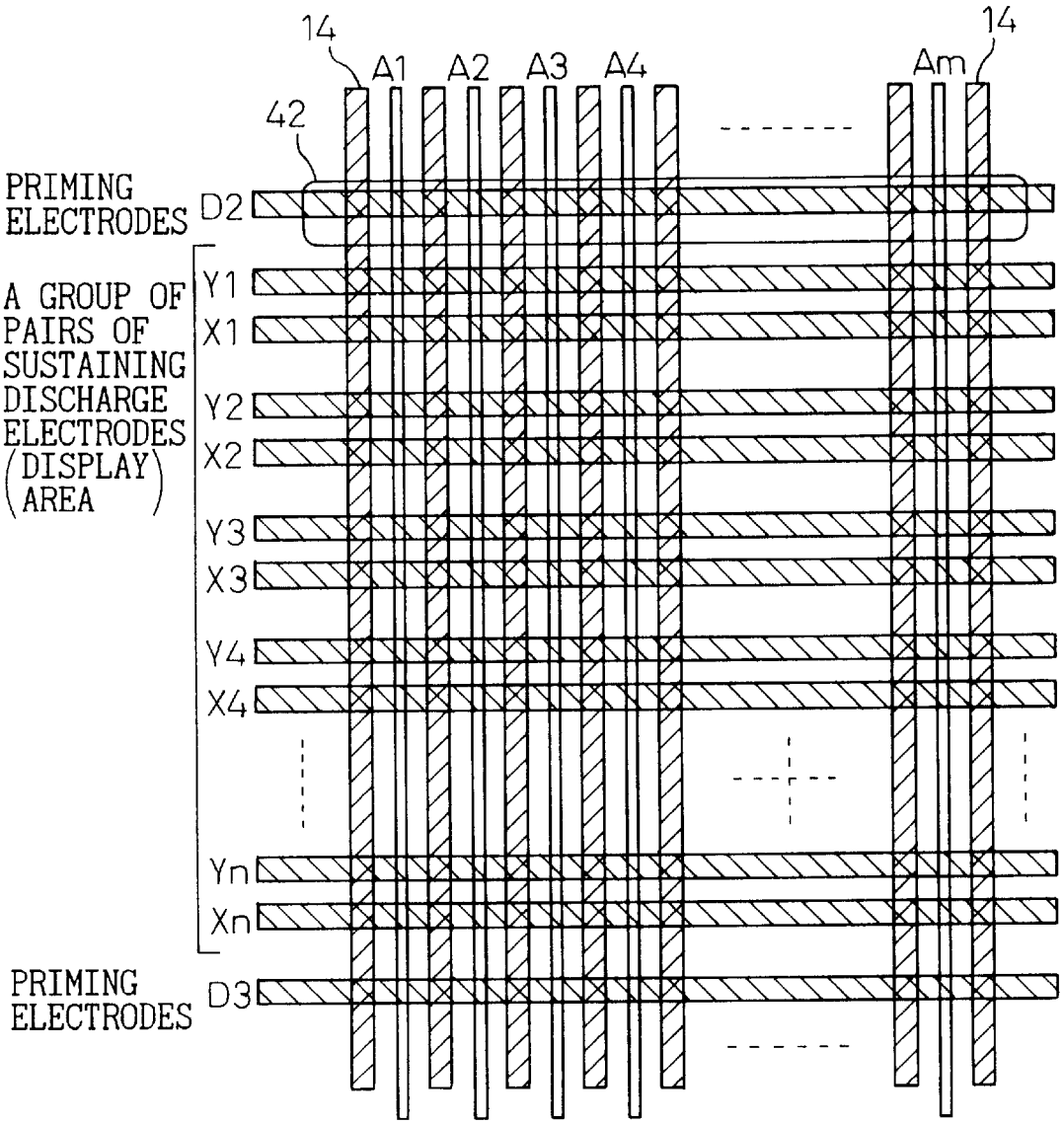
FIG. 16 is a diagram showing the structure of a panel employed in second and third embodiments of the present invention.
Figure 17:
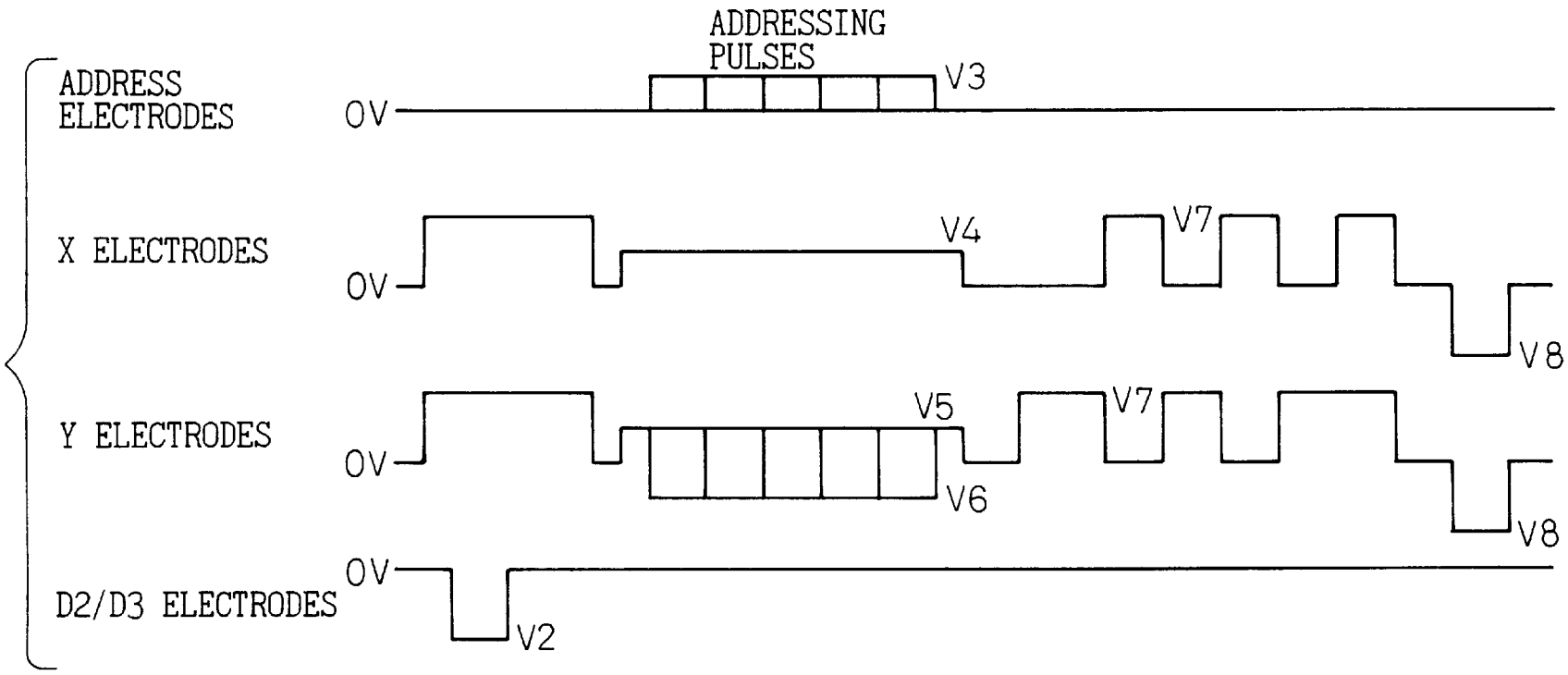
FIG. 17 is a waveform chart showing driving waves employed in the second embodiment.

FIG. 16 is a diagram showing the structure of a panel in a second embodiment of the present invention. A difference from the first embodiment lies in a point that priming electrodes are realized with single electrodes D2 and D3. Priming discharge is carried out by applying voltages to electrodes D2 and Y1 and to electrodes D3 and Xn or by applying voltages to electrode D2 and the address electrodes and to electrode D3 and the address electrodes. FIG. 17 shows driving waves to be applied when priming discharge is carried out in electrodes D2 and Y1 and in electrodes D3 and Xn. The actions performed at the addressing step and sustaining discharge step are identical to those in the first embodiment. In the second embodiment, at the erasure step, erasure discharge is carried out by applying a pulse of a voltage V8 of negative polarity to both the sustaining discharge electrodes. If the pulse duration of the pulse is set to several microseconds, wall charge of opposite polarity is produced. The wall charge works effectively on the next priming discharge. In the second embodiment, priming discharge involves an area 42 in FIG. 16. For intercepting glow stemming from the discharge, it is preferable to widen the light-interceptive member to such an extent that the light-interceptive member borders closely on electrode Y1. The same applies to the light-interceptive member located along the last display line.

Figure 18:
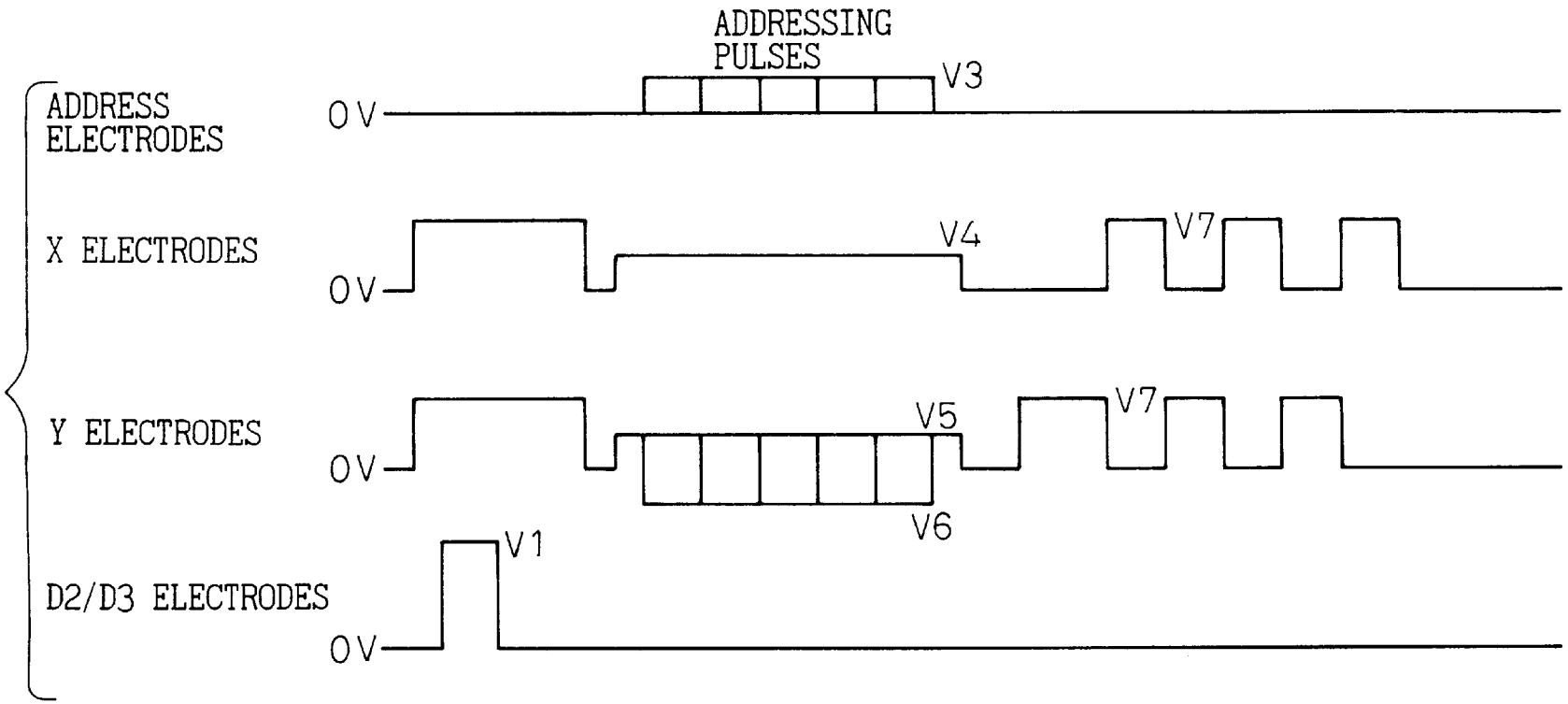
FIG. 18 is a waveform chart showing driving waves employed in the third embodiment.

FIG. 18 is a diagram showing driving waves employed in the third embodiment. The structure of a panel of the third embodiment is the same as that of the second embodiment. In the third embodiment, priming discharge is carried out, for example, between the priming electrode D2 and the address electrodes. The actions made at the addressing step, sustaining discharge step, and erasure step are identical to those in the first embodiment.

As described so far, according to the present invention, discharge triggered by priming occurring in the priming cells is used as a means for producing wall charge uniformly in all the display cells. This obviates the necessity, as in the prior art, of inducing intensive discharge by applying pulses whose voltages are higher than a discharge start voltage. The luminance of glow occurring at the reset step can therefore be minimized. Eventually, display contrast can be improved.

Furthermore, addressing discharge is carried out by effectively utilizing wall charge stemming from priming discharge. Discharge can therefore be induced with application of a low voltage. Drive circuits can therefore be realized at low cost.

Furthermore, since addressing discharge involves only the discharge from the address electrodes to each Y electrode, the addressing discharge is completed quickly. The addressing cycle can therefore be shortened. Consequently, multi-level gray-scale display and driving of a high-definition panel can be achieved.

What is claimed is:

1. A plasma display apparatus, comprising:

a plasma display panel including plural pairs of first and second electrodes arranged to be adjacent to one another in correspondence to respective display lines on a first substrate and coated with an insulating layer facing a discharge space, third electrodes arranged orthogonally to said first and second electrodes and defining therewith a display area, the third electrodes being disposed on said first substrate or on a second substrate opposed to said first substrate with said discharge space therebetween, and priming electrodes, located outside the display area, forming priming cells in which priming discharges are carried out;

a first electrode drive circuit driving said first electrodes;

a second electrode selection drive circuit selectively driving said second electrodes;

a third electrode drive circuit driving said third electrodes; and a priming electrode drive circuit driving said priming electrodes, wherein said priming discharge is induced in said priming cells by applying voltages to said priming electrodes by said priming electrode drive circuit, discharges are then induced successively along all the display lines in said display area while potentials of said first, second and third electrodes are maintained at given constant values and initialization is carried out in all the cells within the display area by said discharges; and addressing discharges are performed on display cells selected in accordance with address information by successively specifying voltages applied to said first, second, and third electrodes; and sustaining discharges producing a display are carried out on the basis of the addressing discharges by applying sustain voltages to said first and second electrodes.

2. A plasma display apparatus according to claim 1, wherein said priming electrode drive circuit is a switching circuit including at least one pair of push-pull circuits.

3. A plasma display apparatus according to claim 1, wherein said initialization is carried out so that all the cells within the display area have wall charges, and said addressing discharge is performed by using said wall charges.

4. A driving method for a plasma display panel including plural pairs of first and second electrodes arranged to be adjacent to one another in correspondence to respective display lines on a first substrate and coated with an insulating layer facing a discharge space, third electrodes arranged orthogonally to said first and second electrodes and defining therewith a display area, the third electrodes being disposed on said first substrate or on a second substrate opposed to said first substrate with said discharge space therebetween, and priming electrodes, located outside a display area, forming priming cells in which priming discharges are carried out, said driving method comprising:

a reset step of performing initialization in all the display cells;

an addressing step of performing addressing discharges on display cells selected in accordance with address information by successively specifying voltages applied to said first, second, and third electrodes; and a sustaining discharge step of carrying out sustaining discharges for display on the basis of the address discharge by applying sustain voltages to said first and second electrodes, wherein, at said reset step, voltages are applied to said priming electrodes in order to carry out priming discharge in said priming cells; and discharges are then induced successively along all the display lines in said display area while potentials of said first, second and third electrodes are maintained at given constant values and initialization is carried out in all the display cells within the display area by said discharges.

5. A driving method according to claim 4, wherein said given voltages to be applied to said display cells at said reset step are smaller than a discharge start voltage and equal to or larger than a minimum sustaining voltage to be applied at said sustaining discharge step.

6. A driving method according to claim 4, wherein:

said priming electrodes are arranged in parallel to each other, adjacent to, and outside opposite parallel sides of the display area and perpendicular to said first and second electrodes outside the display area; and first and second lines of said priming cells are located adjacent to a first display line and a last display line, respectively, of the display area.

7. A driving method according to claim 6, wherein said driving method produces a display of written information in successive frames, each frame comprising a plurality of subfields, the driving method further comprising carrying out the priming discharge along a line which is changed, subfield by subfield, between two lines.

8. A driving method according to claim 6, wherein said priming discharge is carried out along the two lines simultaneously.

9. A driving method according to claim 4, wherein said priming discharge is carried out by applying voltages to said third electrodes and each priming electrodes respectively.

10. A driving method according to claim 9, wherein the voltage to be applied to each priming electrodes for priming discharges is a pulsating voltage whose polarity is the same as that of a given voltage pulse to be applied to said first and second electrodes at said reset step.

11. A driving method according to claim 4, wherein said priming discharge is carried out by applying voltages to each priming electrode and a first or second electrode adjoining the priming electrode, respectively.

12. A driving method according to claim 11, wherein the voltage to be applied to each priming electrode, for priming discharge, is a pulsating voltage whose polarity is opposite to that of a given voltage pulse applied to said first and second electrodes at said reset step.

13. A driving method according to claim 4, wherein each of said priming electrodes comprises a pair of adjoining parallel electrodes, and said priming discharge is carried out by applying voltages to said pair of electrodes.

14. A driving method according to claim 13, wherein said driving method produces a display of written information in successive frames, each frame comprising a plurality of subfields, the driving method further comprising changing the polarities of the voltages applied to said pair of priming electrodes subfield by subfield.

15. A driving method according to claim 4 wherein, at said reset step, the same voltage is applied to said first and second electrodes, and given voltages are applied to said third electrodes and said first and second electrodes, respectively.

16. A driving method according to claim 4 wherein, at said reset step, said third electrodes are grounded and the same voltage of a positive polarity is applied to said first and second electrodes.

17. A driving method according to claim 16, wherein the voltage of a positive polarity, applied to said first and second electrodes at said reset step, is the same as a voltage applied to said first and second electrodes at said sustaining discharge step.

18. A driving method according to claim 4, wherein at said addressing step, a pulse applied to said third electrodes for performing an addressing discharge is a voltage pulse of a positive polarity, and a selection pulse, applied to a first or second electrode, is a voltage pulse of a negative polarity.

19. A driving method according to claim 4 wherein, at said sustaining discharge step and with said third electrodes grounded, a sustaining discharge pulse of positive polarity is applied alternately to said first and second electrodes.

20. A driving method according to claim 4 wherein an erasure discharge step is carried out at the end of said sustaining discharge step.

21. A driving method according to claim 20 wherein, when said erasure discharge is carried out at the end of said sustaining discharge step, a voltage pulse, whose polarity is opposite to that of a voltage applied to said first and second electrodes at said reset step, is applied.

22. A driving method according to claim 4 wherein, at the end of said sustaining discharge step, erasure discharge is carried out by applying a voltage pulse or voltage pulses to one or both of said third electrodes and said first and second electrodes.

23. A driving method according to claim 22 wherein, when said erasure discharge is carried out at the end of said sustaining discharge step, said third electrodes are grounded and a pulse of negative polarity is applied to one or both of said first and second electrodes.

24. A driving method according to claim 4 wherein, when the last sustaining discharge pulse is applied at said sustaining discharge step and immediately after the occurrence of the corresponding sustaining discharge produced thereby, a voltage of a positive polarity, retaining said first and second electrodes and said third electrodes at the same potential, is applied and maintained for a given period of time.

25. A driving method according to claim 24, wherein the voltage applied to said first and second electrodes, immediately after application of the last sustaining discharge pulse and the occurrence of the corresponding sustaining discharge produced thereby at said sustaining discharge step, and maintained, is the voltage of a sustaining discharge pulse.

26. A driving method according to claim 4 wherein, at the end of said sustaining discharge step, a pulse, whose polarity is opposite to that of a voltage applied at said reset step, is applied in order to discharge all the cells.

27. A driving method for a plasma display panel according to claim 4, wherein all the cells within the display area after said initialization have wall charges, and said addressing discharge is performed by using said wall charges.

28. A plasma display panel, comprising:

a plurality of electrodes provided in a display area and forming display cells; and priming electrodes located outside said display area and forming priming cells, a discharge in said display cells being induced by a priming discharge generated in said priming cells while potentials of said plurality of electrodes are maintained at given constant values.

29. A plasma display panel according to claim 28, wherein:

said plurality of electrodes include:

first and second electrodes arranged in parallel to one another along display lines on a first substrate and coated with an insulating layer facing a discharge space, and third electrodes arranged orthogonally to said first and second electrodes on said first substrate or on a second substrate opposed to said first substrate with the discharge space therebetween; and said priming electrodes are formed in parallel to said first and second electrodes on one side or both sides of said display area, perpendicular to said first and second electrodes and outside said display area.

30. A plasma display panel according to claim 28, wherein:

said plurality of electrodes include:

first and second electrodes arranged in parallel to one another along display lines on a first substrate and coated with an insulating layer facing a discharge space, and third electrodes arranged orthogonally to said first and second electrodes on said first substrate or on a second substrate opposed to said first substrate; and said priming electrodes comprise at least one pair of priming electrodes parallel to said first and second electrodes.

31. A plasma display panel according to claim 28, wherein:

said plurality of electrodes include:

first and second electrodes arranged in parallel to one another along display lines on a first substrate and coated with an insulating layer facing a discharge space, and third electrodes arranged orthogonally to said first and second electrodes on said first substrate or on a second substrate opposed to said first substrate; and said plasma display panel further comprises light-interceptive members formed near said priming cells on the side of the display side of said first substrate.

32. A plasma display panel according to claim 31, wherein the light-interceptive members block light from the priming discharge from entering the display area.

33. A plasma display panel, comprising:

a plurality of electrodes provided in a display area and forming display cells;

priming electrodes located outside the display area and forming priming cells;

a priming electrode drive circuit generating priming discharges in said priming cells and establishing wall charges and inducing discharges in said display cells in an initialization stage while potentials of said plurality of electrodes are maintained at given constant values; and light-interceptive members, disposed relative to respective priming electrodes, intercepting light emitted by the priming discharges and avoiding illumination of the display area by such emitted light.

34. A plasma display panel according to claim 33 applying voltages selectively to the electrodes forming display cells selected corresponding to information to be written and displayed thereby in the display area, the voltages being less than a value of voltages required to initiate discharges in the display cells in the absence of wall charges being introduced therein by the priming discharges in the initialization stage.

35. A method of driving a three-electrode type plasma display panel having a matrix of display cells defined by respective intersections, within a display area, of orthogonally related address electrodes and plural pairs of display electrodes and priming cells, defined by respective intersections of priming electrodes with the address electrodes, the priming electrodes being disposed adjacent to but outside the display area and extending transverse to the address electrodes and parallel to the display electrodes, comprising:

producing a priming discharge in the priming cells while maintaining a voltage at each display cell at a constant level, less than a level required to initiate a discharge but sufficient for the priming discharge in the priming cells to induce priming discharges in all of the display cells;

selectively intercepting light produced by the priming discharges in the priming cells; and maintaining the constant level voltage at each display cell for a sufficient time until the priming discharge in the priming cells has spread in succession to all display cells in the display area and, upon all display cells discharging, terminating the priming discharge in the priming cells.

36. The method according to claim 35, wherein the priming electrodes comprise first and second priming electrodes and the display electrodes comprise first through last pairs of electrode X1, Y1 through Xn, Yn, respectively, a first priming electrode adjacent to the outer electrode of the first electrode pair X1, Y1 and a second priming electrode adjacent to the outer electrode of the last electrode pair Xn, Yn, the step of producing a priming discharge further comprising:

applying voltages of a discharge initiating level respectively to the first priming electrode and the outer electrode of the first electrode pair X1, Y1 and to the second priming electrode and the outer electrode of the last electrode pair Xn, Yn.

37. The method according to claim 35, wherein the priming electrodes comprise first and second pairs of priming electrodes and the display electrodes comprise first through last electrode pairs X1, Y1 through Xn, Yn, respectively, a first pair of priming electrodes adjacent to the first electrode pair X1, Y1 and a second pair of priming electrodes adjacent to the last electrode pair Xn, Yn, the step of producing a priming discharge further comprising:

applying voltages of a discharge initiating level respectively to the first and second pairs of priming electrodes.

38. The method as recited in claim 35, wherein the priming discharge produces a spatial charge in each priming discharge cell, the priming discharges spreading throughout the display cells of the display area by spreading of the spatial charge.

39. The method as recited in claim 35, wherein the priming discharge is produced in a reset period.

40. A plasma display apparatus comprising:

a three-electrode type plasma display panel having a matrix of display cells defined by respective intersections, within a display area, of orthogonally related address electrodes and plural pairs of display electrodes, and priming cells defined by respective intersections of priming electrodes with the address electrodes and disposed adjacent to but outside the display area, the priming electrodes extending transverse to the display electrodes and parallel to the display electrodes:

a priming electrode drive circuit producing a priming discharge in the priming cells while maintaining a voltage at each display cell at a constant level, less than a level required to initiate a discharge but sufficient for the priming discharge in the priming cells to induce priming discharges in all of the display cells;

light-interceptive members selectively intercepting light produced by the priming discharges in the priming cells and not intercepting light emitted by discharges in the display cells; and the priming electrode drive circuit maintaining the constant level voltage at each display cell for a sufficient time until the priming discharge in the priming cells has spread in succession to all display cells in the display area and, upon all display cells discharging, terminating the priming discharge in the priming cells.

41. The plasma display apparatus according to claim 40, wherein:

the priming electrodes comprise first and second priming electrodes and the display electrodes comprise first through last electrode pairs X1, Y1 through Xn, Yn, respectively, a first priming electrode adjacent to the outer electrode of the first electrode pair X1, Y1 and a second priming electrode adjacent to the outer electrode of the last electrode pair Xn, Yn; and the priming electrode device circuit applies voltages of a discharge initiating level respectively to the first priming electrode and the outer electrode of the first electrode pair X1, Y1 and to the second priming electrode and the outer electrode of the last electrode pair Xn, Yn.

42. The plasma display apparatus according to claim 40, wherein:

the priming electrodes comprise first and second pairs of priming electrodes and the display electrodes comprise first through last electrode pairs X1, Y1 through Xn, Yn, respectively, a first pair of priming electrodes adjacent to the first electrode pair X1, Y1 and a second pair of priming electrodes adjacent to the last electrode pair Xn, Yn; and the priming electrode drive circuit applies voltages of a discharge initiating level respectively to the first and second pairs of priming electrodes.

43. The plasma display apparatus as recited in claim 40, wherein:

the priming discharge produces a spatial charge in each priming discharge cell, the priming discharges spreading throughout the display cells of the display area by spreading of the spatial charge.

44. The plasma display apparatus as recited in claim 40, wherein the priming discharge is produced in a reset period.

* * * * *